US010570787B2

(12) United States Patent
Miyazaki

(10) Patent No.: US 10,570,787 B2
(45) Date of Patent: Feb. 25, 2020

(54) OIL CIRCULATION SYSTEM OF INTERNAL COMBUSTION ENGINE

(71) Applicant: TOYOTA JIDOSHA KABUSHIKI KAISHA, Toyota-shi, Aichi-ken (JP)

(72) Inventor: Yuichi Miyazaki, Susono (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/991,664

(22) Filed: May 29, 2018

(65) Prior Publication Data

US 2018/0347418 A1 Dec. 6, 2018

(30) Foreign Application Priority Data

May 31, 2017 (JP) ..... 2017-108690

(51) Int. Cl.
*F01M 11/04* (2006.01)
*F01M 5/00* (2006.01)
(Continued)

(52) U.S. Cl.
CPC ..... *F01M 5/007* (2013.01); *F01M 5/021* (2013.01); *F01M 11/0004* (2013.01);
(Continued)

(58) Field of Classification Search
CPC ..... F01M 11/0004; F01M 2011/0045; F01M 2001/123; F01M 2005/023; F01M 2011/0037; F01M 5/00
See application file for complete search history.

(56) References Cited

U.S. PATENT DOCUMENTS

2003/0230274 A1* 12/2003 Williams ..... F01M 1/02 123/196 R
2004/0178041 A1* 9/2004 Kraxner ..... F16D 25/12 192/85.61
(Continued)

FOREIGN PATENT DOCUMENTS

JP 61229916 A * 10/1986
JP S62-174517 A 7/1987
(Continued)

OTHER PUBLICATIONS

Kenichi Yamada, et al., "Development of Dual Chamber Oil Pan for Improving Engine Warm-up Performance". 2012 JSAE (Society of Automotive Engineers of Japan) Annual Congress (Spring) paper 235-20125071, May 24, 2012, 4 pages.

*Primary Examiner* — Long T Tran
(74) *Attorney, Agent, or Firm* — Hunton Andrews Kurth LLP

(57) ABSTRACT

The oil circulation system of an internal combustion engine comprises: a high temperature side oil circulation path provided with a high temperature side oil pan, a high temperature side part supplied with oil, and a heating part, and circulating oil among these; a low temperature side oil circulation path provided with a low temperature side oil pan and a low temperature side part supplied with oil, and circulating oil between the low temperature side oil pan and the low temperature side part supplied with oil; an oil transport mechanism transporting oil between the low temperature side oil circulation path and the high temperature side oil circulation path; and a control device configured to control transport of oil by the oil transport mechanism while the internal combustion engine is operating.

4 Claims, 14 Drawing Sheets

(51) Int. Cl.
*F01M 5/02* (2006.01)
*F01M 11/00* (2006.01)
*F01M 11/03* (2006.01)

(52) U.S. Cl.
CPC ..... *F01M 2005/023* (2013.01); *F01M 2011/0029* (2013.01); *F01M 2011/0045* (2013.01); *F01M 2011/035* (2013.01)

(56) References Cited

U.S. PATENT DOCUMENTS

2008/0308353 A1* 12/2008 Aixala ..... F01M 1/16 184/6.5
2009/0241864 A1* 10/2009 Sugiura ..... F01P 3/00 123/41.1
2010/0300395 A1* 12/2010 Enokida ..... F01M 11/0004 123/195 R
2012/0132172 A1* 5/2012 Kobayashi ..... F01M 1/08 123/196 R
2014/0190444 A1* 7/2014 Inoue ..... F01M 1/16 123/196 R
2014/0360463 A1* 12/2014 Hokuto ..... F01M 11/0004 123/344
2015/0218980 A1* 8/2015 Bonde ..... F01M 1/02 184/6.5
2015/0285437 A1 10/2015 Anzawa
2017/0198803 A1* 7/2017 Tokozakura ..... F16H 57/0413
2017/0350346 A1* 12/2017 Pegg ..... F01M 11/0004

FOREIGN PATENT DOCUMENTS

JP H04-111505 U 9/1992
JP 2006144688 A 6/2006
JP 2012-137016 A 7/2012
JP 2014101803 A 6/2014
JP 5747500 B2 7/2015
JP 2016118122 A 6/2016
JP 2017078377 A 4/2017

* cited by examiner

OIL CIRCULATION SYSTEM OF INTERNAL COMBUSTION ENGINE

CROSS-REFERENCE TO RELATED APPLICATION

The present application claims priority to Japanese Patent Application No. 2017-108690 filed on May 31, 2017, which is incorporated herein by reference in its entirety.

TECHNICAL FIELD

The present invention relates to an oil circulation system of an internal combustion engine.

BACKGROUND ART

Several components (crank journals etc.,) of internal combustion engines are supplied with oil by an oil circulation system while the internal combustion engine is operating. The oil circulation system makes oil circulate between an oil pan storing oil and parts supplied with oil.

PLT 1 describes that the temperature of the oil supplied to the parts supplied with oil is increased by utilizing the heat of the exhaust gas, in order to lower the mechanical resistance of the parts supplied with oil to improve the fuel efficiency of an internal combustion engine. Specifically, while the internal combustion engine is warming up, a part of the oil is run through oil paths near the exhaust ports so as to heat the oil by the high temperature exhaust gas in the exhaust ports.

CITATION LIST

Patent Literature

PLT 1: Japanese Patent Publication No. 2012-137016A

PLT 2: Japanese Patent Publication No. 62-174517A

PLT 3: Japanese Utility Model Publication No. 4-111505U

SUMMARY OF INVENTION

Technical Problem

However, in the oil circulation system described in PLT 1, while the internal combustion engine is warming up, the oil supplied to the oil paths in the vicinities of the exhaust ports and the oil supplied to the parts supplied with oil without passing through the oil paths in the vicinities of the exhaust ports are returned to the same oil pan (inner oil pan). For this reason, the small amount of oil which has been heated and the large amount of oil which has not been heated are mixed in the oil pan, so the oil as a whole cannot be effectively increased in temperature.

In view of this, the inventors of the present application took note of the relationship between the temperature of the oil at the parts supplied with oil and the mechanical resistance, and discovered that in order to improve the fuel efficiency of an internal combustion engine, it is not necessarily required to supply high temperature oil to all of the parts supplied with oil. Based on this fact, in the oil circulation system devised by the inventors of the present application, a high temperature side oil circulation path configured to supply oil heated by the heating part to part of the parts supplied with oil, and a low temperature side oil circulation path configured to supply oil not heated by the heating part to the remaining parts supplied with oil are separately provided. As a result, while the internal combustion engine is warming up, it is possible to quickly increase the temperature of the oil in the high temperature side oil circulation path and in turn possible to improve the fuel efficiency of the internal combustion engine.

However, after the internal combustion engine has warmed up, the temperature inside the high temperature side oil circulation path is liable to excessively rise and the oil is liable to be burnt etc. Further, oil is liable to move when the vehicle in which the internal combustion engine is provided is turning etc., and the oil in the low temperature side oil circulation path or high temperature side oil circulation path may become insufficient. Therefore, the oil in the low temperature side oil circulation path or high temperature side oil circulation path is liable to degrade in condition.

Therefore, in consideration of the above problem, an object of the present invention is to suppress the deterioration of the condition of the oil in the low temperature side oil circulation path or high temperature side oil circulation path, in an oil circulation system comprising a high temperature side oil circulation path configured to make oil rise in temperature by a heating part, and a low temperature side oil circulation path in which a heating part is not provided.

Solution to Problem

The summary of the present disclosure is as follows.

(1) An oil circulation system of an internal combustion engine comprising: a high temperature side oil circulation path provided with a high temperature side oil pan storing oil, a high temperature side part supplied with oil to which oil in the high temperature side oil pan is supplied, and a heating part heating oil supplied to the high temperature side part supplied with oil, and circulating oil among the high temperature side oil pan, the high temperature side part supplied with oil and the heating part; a low temperature side oil circulation path provided with a low temperature side oil pan storing oil and a low temperature side part supplied with oil to which oil in the low temperature side oil pan is supplied, and circulating oil between the low temperature side oil pan and the low temperature side part supplied with oil; an oil transport mechanism transporting oil between the low temperature side oil circulation path and the high temperature side oil circulation path; and a control device configured to control transport of oil by the oil transport mechanism while the internal combustion engine is operating.

(2) The oil circulation system of an internal combustion engine described in above (1), further comprising a high temperature side oil temperature sensor detecting a temperature of the oil in the high temperature side oil circulation path, wherein the control device is configured to transport oil from the low temperature side oil circulation path to the high temperature side oil circulation path by the oil transport mechanism when the temperature of the oil detected by the high temperature side oil temperature sensor is equal to or greater than a predetermined first temperature.

(3) The oil circulation system of an internal combustion engine described in above (2), wherein the high temperature side oil circulation path is configured so that oil circulates through the high temperature side oil pan, the heating part, and the high temperature side part supplied with oil in that order, and the high temperature side oil temperature sensor is provided between the heating part and the high temperature side part supplied with oil.

(4) The oil circulation system of an internal combustion engine described in any one of above (1) to (3), further comprising an environmental temperature sensor detecting an environmental temperature, wherein the high temperature side oil pan and the low temperature side oil pan are configured so that oil in the high temperature side oil pan moves into the low temperature side oil pan when the oil in the high temperature side oil pan becomes equal to or greater than a predetermined amount while the internal combustion engine is operating, and the control device is configured to transport oil from the low temperature side oil circulation path to the high temperature side oil circulation path by the oil transport mechanism if the environmental temperature detected by the environmental temperature sensor is equal to or less than a predetermined second temperature when the internal combustion engine is started up.

(5) The oil circulation system of an internal combustion engine described in above (4), further comprising a low temperature side oil temperature sensor detecting a temperature of the oil in the low temperature side oil circulation path, wherein the control device is configured to transport oil from the low temperature side oil circulation path to the high temperature side oil circulation path by the oil transport mechanism until the temperature detected by the low temperature side oil temperature sensor reaches a predetermined third temperature if the environmental temperature detected by the environmental temperature sensor is equal to or less than the second temperature when the internal combustion engine is started up.

(6) The oil circulation system of an internal combustion engine described in any one of above (1) to (5), wherein the oil transport mechanism comprises an oil jet ejecting oil toward an inside of a piston provided in the internal combustion engine and, the oil jet is provided at the low temperature side oil circulation path, and the high temperature side oil pan is configured to recover oil ejected by the oil jet.

(7) The oil circulation system of an internal combustion engine described in any one of above (1) to (6), wherein the high temperature side oil pan and the low temperature side oil pan are configured so that oil in the high temperature side oil pan and oil in the low temperature side oil pan are mixed while the internal combustion engine is stopped.

(8) The oil circulation system of an internal combustion engine described in any one of above (1) to (7), wherein the heating part includes a heating oil path formed around an exhaust port.

(9) The oil circulation system of an internal combustion engine described in any one of above (1) to (8), wherein the high temperature side part supplied with oil includes a crank journal.

Advantageous Effects of Invention

According to the present invention, it is possible to suppress the deterioration of the condition of the oil in the low temperature side oil circulation path or high temperature side oil circulation path, in an oil circulation system comprising a high temperature side oil circulation path configured to make oil rise in temperature by a heating part, and a low temperature side oil circulation path in which a heating part is not provided.

DESCRIPTION OF EMBODIMENTS

Figure 1:
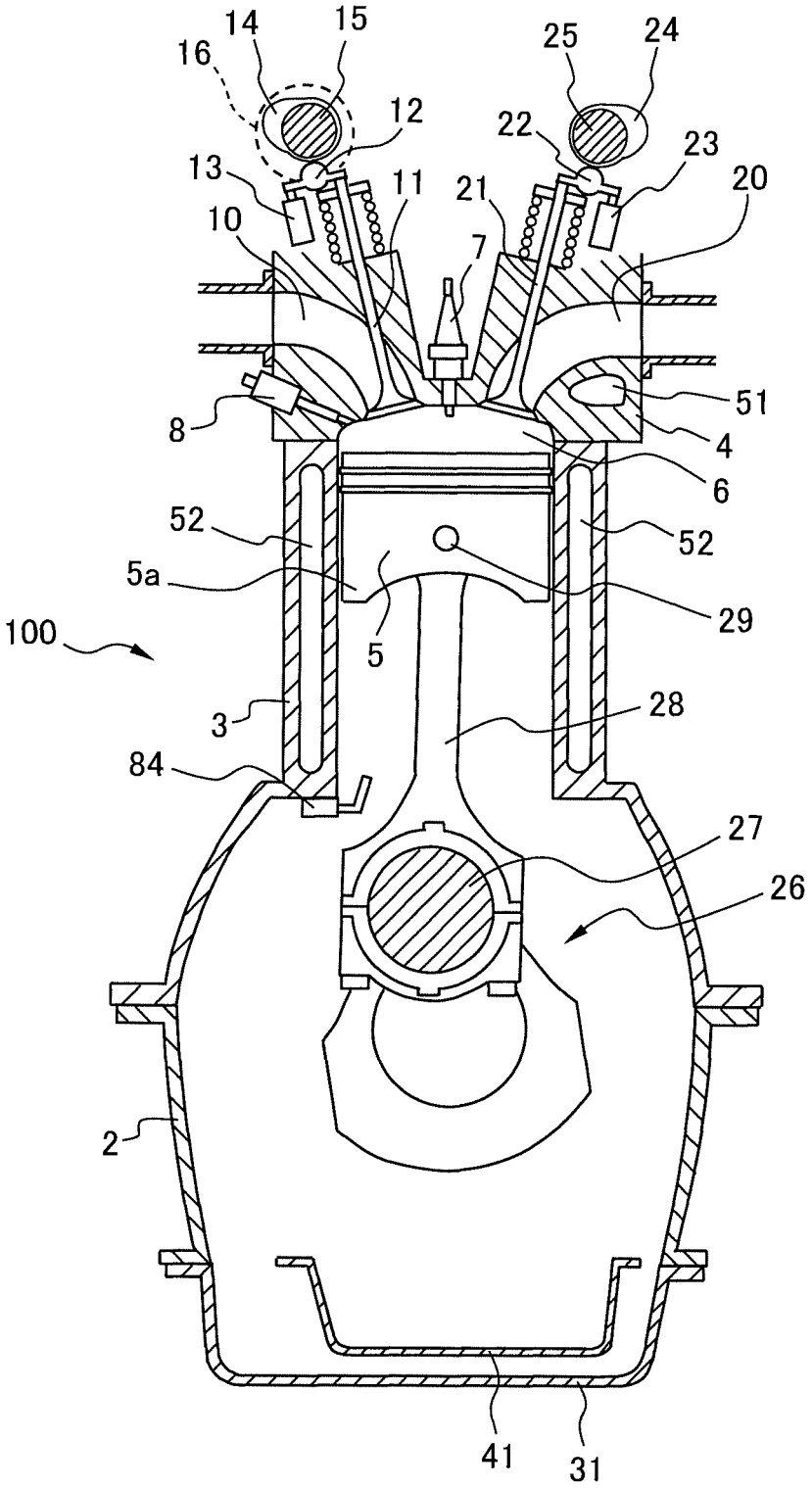
FIG. 1 is a schematic lateral cross-sectional view of an internal combustion engine comprising an oil circulation system according to a first embodiment of the present invention.

Below, referring to the drawings, embodiments of the present invention will be explained in detail. Note that, in the following explanation, similar components are assigned the same reference notations.

First Embodiment

First, referring to FIG. 1 to FIG. 9, a first embodiment of the present invention will be explained.

<Configuration of Internal Combustion Engine>

FIG. 1 is a schematic lateral cross-sectional view of an internal combustion engine 100 including an oil circulation system according to the first embodiment of the present invention. As shown in FIG. 1, the internal combustion engine 100 comprises a crankcase 2, cylinder block 3, cylinder head 4, pistons 5, and combustion chambers 6. The cylinder block 3 is arranged on the crankcase 2. The cylinder head 4 is arranged on the cylinder block 3, while the pistons 5 reciprocate up and down inside cylinders formed inside the cylinder block 3. The combustion chambers 6 are defined by the cylinder head 4, cylinders, and pistons 5.

The cylinder head 4 includes spark plugs 7 arranged at the center parts of the top surfaces of the combustion chambers 6 and igniting the air-fuel mixture inside the combustion chambers 6, and fuel injectors 8 injecting fuel to the combustion chambers 6.

Further, the cylinder head 4 is formed with intake ports 10 through which intake gas flows and includes intake valves 11 opening and closing intake ports 10. The upper end parts of the intake valves 11 are arranged so as to contact one end parts of intake rocker arms 12. The intake rocker arms 12 are arranged so that the other end parts contact intake lash adjusters 13 and their center parts contact the intake cams 14. The intake lash adjusters 13 bias the intake rocker arms 12 so that the valve clearances of the intake valves 11 become zero.

The intake cams 14 are fixed to an intake camshaft 15 and rotate along with rotation of the intake camshaft 15. The intake camshaft 15 is supported by bearings (not shown) formed at the cylinder head 4 and rotates inside the bearings. In the present embodiment, the bearings supporting the intake camshaft are sliding bearings, while the intake cam journals provided at the intake camshaft 15 rotate inside the bearings.

When the intake camshaft 15 rotates, the intake cams 14 rotate along with this. Due to this, the intake rocker arms 12 are pushed by the intake cams 14. By the intake rocker arms 12 being pushed by the intake cams 14 in this way, they swing downward about the end parts contacting the intake lash adjusters 13. Due to this, the intake valves 11 are made to open.

Further, in the present embodiment, the end part of the intake camshaft 15 is provided with an intake variable valve timing system (VVT system). This VVT system changes the relative angle between an intake cam pulley driven by a timing belt and the intake camshaft by hydraulic pressure so as to change the valve timings of the intake valves 11. The VVT system is connected to an oil control valve (OCV). This OCV is used to control the hydraulic pressure supplied to the VVT system and thereby control the valve timings of the intake valves 11.

In addition, the cylinder head 4 is formed with exhaust ports 20 through which exhaust gas flows and is provided with exhaust valves 21 opening and closing the exhaust ports 20. The upper end parts of the exhaust valves 21 are arranged so as to contact one end parts of the exhaust rocker arms 22. The exhaust rocker arms 22 are arranged so that the other end parts contact the exhaust lash adjusters 23 and the center parts contact exhaust cams 24. The exhaust lash adjusters 23 bias the exhaust rocker arms 22 so that the valve clearances of the exhaust valves 21 become zero.

The exhaust cams 24 are fixed to an exhaust camshaft 25 and rotate along with rotation of the exhaust camshaft 25. The exhaust camshaft 25 is supported by bearings (not shown) formed in the cylinder head 4 and rotates inside the bearings. In the present embodiment, the bearings supporting the exhaust camshaft 25 are sliding bearings. The exhaust cam journals provided at the exhaust camshaft 25 rotate inside the bearings. Note that, an end part of the exhaust camshaft may also be provided with an exhaust variable valve timing system.

The pistons 5 are connected through connecting rods 28 to a crankshaft 26. The connecting rods 28 are connected to piston pins 29 at one end parts and are connected to crank pins 27 of the crankshaft 26 at the other end parts. The connecting rods 28 connect the piston pins 29 and crank pins 27 so as to convert the reciprocating motion of the pistons 5 to rotational motion of the crankshaft 26.

The crankshaft 26 is supported by bearings (not shown) formed in the cylinder block 3 and rotates inside the bearings. In the present embodiment, the bearings supporting the crankshaft 26 are sliding bearings. The crank journals provided at the crankshaft 26 rotate inside the bearings. Note that, in the present embodiment, the bearings for the crankshaft 26 are formed in the cylinder block 3, but may be formed so that halves are provided at both the cylinder block 3 and the crankcase 2.

<Configuration of Oil Circulation System>

Figure 2:
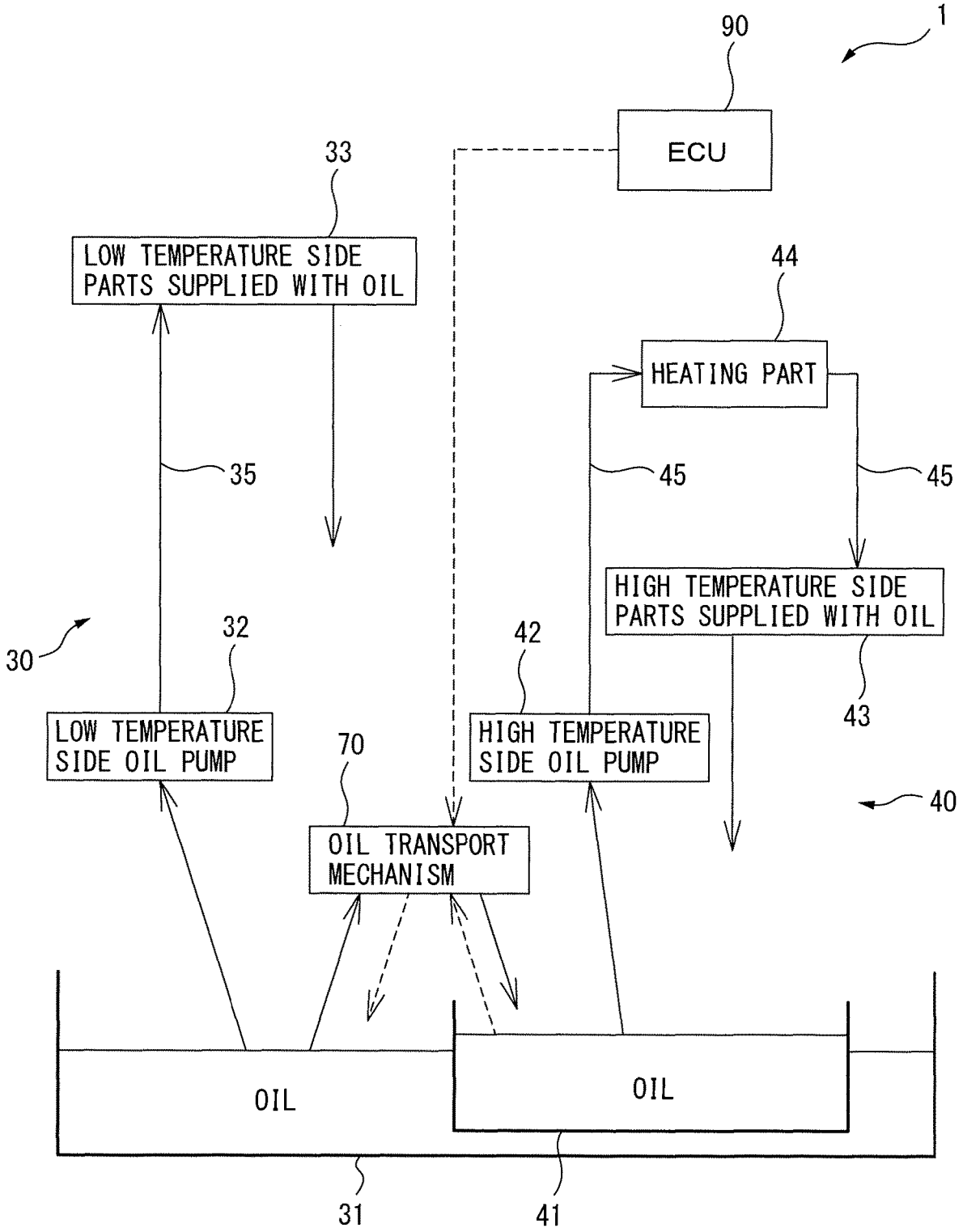
FIG. 2 is a view schematically showing the configuration of an oil circulation system of an internal combustion engine according to the first embodiment of the present invention.

FIG. 2 is a view schematically showing the configuration of the oil circulation system 1 of the internal combustion engine 100 according to the first embodiment of the present invention. The oil circulation system 1 supplies oil to the targeted parts so as to lubricate, cool, or operate a part of the parts provided at the internal combustion engine 100. The oil circulation system 1 comprises a high temperature side oil circulation path 40 configured to make oil quickly rise in temperature while the internal combustion engine 100 is warming up, and a low temperature side oil circulation path 30 configured to make the oil gradually rise in temperature while the internal combustion engine is warming up. The high temperature side oil circulation path 40 and low temperature side oil circulation path 30 are made to circulate oil independently from each other.

The low temperature side oil circulation path 30 comprises a low temperature side oil pan 31 storing oil, a low temperature side oil pump 32 pumping up oil from the low temperature side oil pan 31, and low temperature side parts supplied with oil 33 to which oil in the low temperature side oil pan 31 is supplied. The low temperature side oil circulation path 30 makes oil circulate between the low temperature side oil pan 31 and low temperature side parts supplied with oil 33.

As shown in FIG. 1, the low temperature side oil pan 31 is directly attached to the crankcase 2 so as to cover the entire opening at the bottom of the crankcase 2. The low temperature side oil pump 32 pumps up oil in the low temperature side oil pan 31 through a low temperature side oil strainer (not shown) removing foreign matter in the oil. The low temperature side oil pump 32 supplies the oil in the low temperature side oil pan 31 to the low temperature side parts supplied with oil 33. The low temperature side oil pump 32 is a mechanical type oil pump or electric powered type oil pump. A mechanical type oil pump is driven by rotation of the crankshaft 26, while an electric powered type oil pump is driven by electric power supplied from a battery.

In the low temperature side high pressure oil path 35 between the low temperature side oil pump 32 and the low temperature side parts supplied with oil 33, high pressure oil increased in pressure by the low temperature side oil pump 32 flows. The oil supplied to the low temperature side parts supplied with oil 33 is opened to the atmosphere and drips down into the low temperature side oil pan 31 by gravity. Therefore, the oil supplied from the low temperature side oil pan 31 to the low temperature side parts supplied with oil 33 is again returned to the low temperature side oil pan 31. Note that, the low temperature side high pressure oil path 35 may be provided with a low temperature side oil filter removing minute foreign matter in the oil.

The high temperature side oil circulation path 40 is provided with a high temperature side oil pan 41 storing oil, a high temperature side oil pump 42 pumping up oil from the high temperature side oil pan 41, high temperature side parts supplied with oil 43 to which the oil in the high temperature side oil pan 41 is supplied, and a heating part 44 heating oil supplied to the high temperature side parts supplied with oil 43. The high temperature side oil circulation path 40 makes oil circulate among the high temperature side oil pan 41, the high temperature side parts supplied with oil 43, and the heating part 44.

The high temperature side oil pan 41 is arranged inside the low temperature side oil pan 31. In other words, the low temperature side oil pan 31 is arranged so as to surround the high temperature side oil pan 41. The capacity of the high temperature side oil pan 41 is smaller than the capacity of the low temperature side oil pan 31. The amount of oil stored in the high temperature side oil pan 41 is smaller than the amount of oil stored in the low temperature side oil pan 31. Due to this, it is possible to promote the rise in temperature of the oil in the high temperature side oil circulation path 40.

Note that, the high temperature side oil pan 41 and low temperature side oil pan 31 are not limited in configuration to the above. For example, the high temperature side oil pan 41 may be arranged so as to adjoin the low temperature side oil pan 31. In this case, the high temperature side oil pan 41 is arranged at the outside of the low temperature side oil pan 31. Further, the capacity of the high temperature side oil pan 41 may be larger than the capacity of the low temperature side oil pan 31 and the amount of oil stored in the high temperature side oil pan 41 may be larger than the amount of oil stored in the low temperature side oil pan 31.

The high temperature side oil pump 42 pumps up the oil in the high temperature side oil pan 41 through a high temperature side oil strainer (not shown) removing foreign matter in the oil. The high temperature side oil pump 42 supplies the oil in the high temperature side oil pan 41 to the heating part 44. Further, the high temperature side oil pump 42 supplies the oil in the high temperature side oil pan 41 through the heating part 44 to the high temperature side parts supplied with oil 43.

The high temperature side oil pump 42, like the low temperature side oil pump 32, is a mechanical type oil pump or an electric powered type oil pump. Note that, in the present embodiment, the high temperature side oil pump 42 and the low temperature side oil pump 32 are separate pumps, but they may be an integral single oil pump. In this case, for example, two pump systems with mutually independent oil paths are provided inside a single oil pump, and these two pump systems are driven by a single drive shaft.

The heating part 44 is for example an oil path formed in the vicinity of the exhaust passage of the internal combustion engine 100. In this case, the oil flowing through the heating part 44 is heated by heat exchange with the high temperature exhaust gas flowing through the exhaust passage. Further, at the exhaust ports 20, exhaust gas right after being discharged from the combustion chambers 6 flows, so in general the temperature inside the exhaust ports 20 become higher than the exhaust passage at the downstream side from the exhaust ports 20 (exhaust manifold, exhaust pipe, etc.). For this reason, by using a first heating oil path 51 formed in the vicinities of the exhaust ports 20 as the heating part, it is possible to promote the rise in temperature of the oil. The first heating oil path 51, for example, as shown in FIG. 1, is formed at the cylinder head 4 so as to extend in the horizontal direction in the vicinities of the exhaust ports 20 connected to the cylinders.

Further, the heating part 44 may be second heating oil path 52 formed in the vicinities of the cylinders. In this case, the oil flowing through the second heating oil paths 52 is heated by the heat generated by combustion of the air-fuel mixture in the combustion chambers 6. The second heating oil path 52 is formed at the cylinder block 3 so as to for example partially extend in the circumferential directions of the cylinders and, as shown in FIG. 1, extend also in the axial directions of the cylinders.

Further, when the oil circulation system 1 is provided in a hybrid vehicle in which an internal combustion engine 100 and motor are used as drive sources, the heating part 44 may be arranged outside of the internal combustion engine 100.

Figure 3:
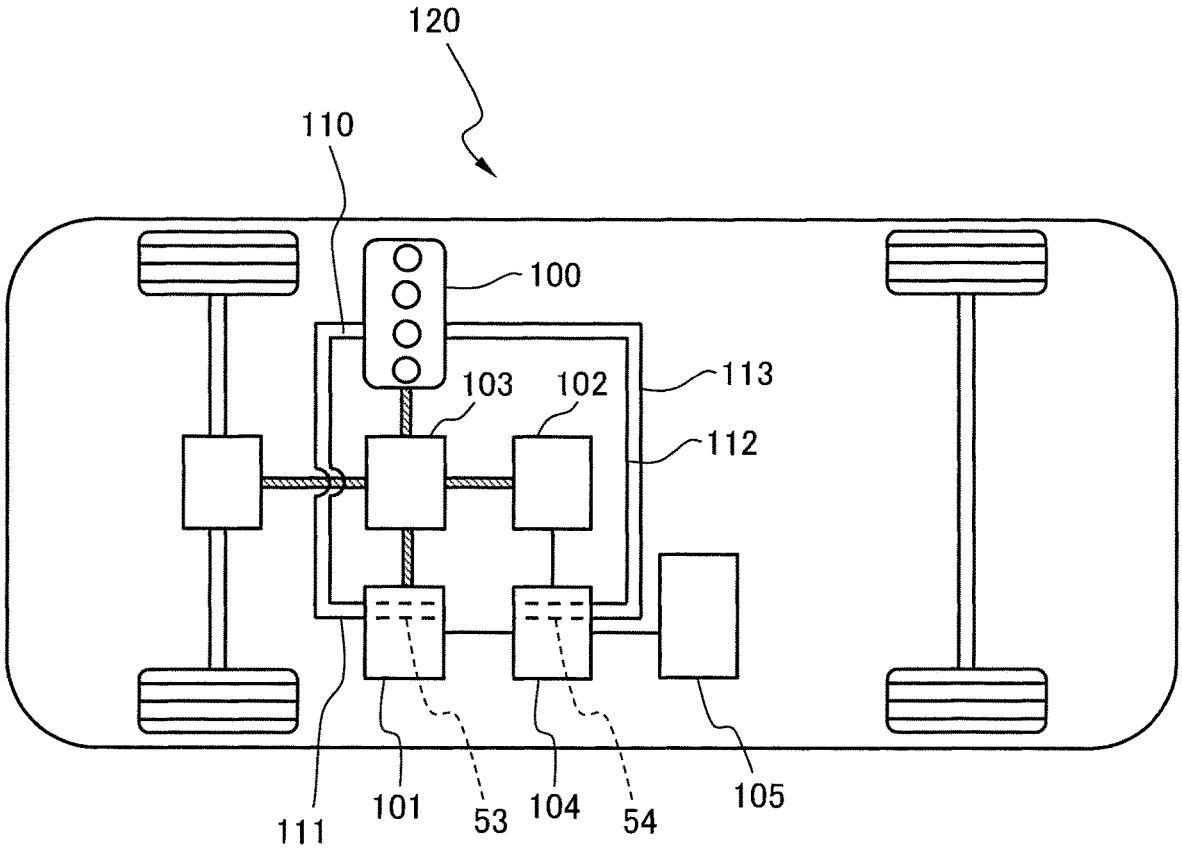
FIG. 3 is a view schematically showing a power train of a hybrid vehicle in which an oil circulation system is provided.

FIG. 3 is a view schematically showing the power train of a hybrid vehicle 120 in which the oil circulation system 1 is provided.

As shown in FIG. 3, the hybrid vehicle 120 comprises, in addition to the internal combustion engine 100, a motor 101, a generator 102, and a power split device 103. The motor 101 drives the vehicle together with the internal combustion engine 100. The generator 102 generates electric power from the drive power of the internal combustion engine 100 or the kinetic energy of the hybrid vehicle 120. The power split device 103 is mechanically linked with the internal combustion engine 100, motor 101, and generator 102 by shafts and gears and splits drive power among these. The power split device 103 is, for example, comprised of planetary gears.

Further, the hybrid vehicle 120 comprises a power control unit (PCU) 104 electrically connected to the motor 101 and generator 102, and a battery 105 connected to the PCU 104. The PCU 104 controls the motor 101 and generator 102 and comprises an inverter, DC-DC converter, etc., to convert the electric power supplied to the motor 101 and convert the electric power supplied from the generator 102.

If the motor 101 and the PCU 104 are actuated when the hybrid vehicle 120 is running, they become extremely high in temperature. For this reason, a third heating oil path 53 formed in the vicinity of the motor 101 and a fourth heating oil path 54 formed in the vicinity of the PCU 104 (in particular, inverter of PCU 104 or other converter) can be used as the heating part 44. In this case, between the internal combustion engine 100 and the motor 101, a motor-use oil supply pipe 110 and motor-use oil return pipe 111 are provided, while between the internal combustion engine 100 and the PCU 104, a PCU-use oil supply pipe 112 and PCU-use oil return pipe 113 are provided.

The oil discharged from the high temperature side oil pump 42 of the internal combustion engine 100 passes through the motor-use oil supply pipe 110 and is supplied to the third heating oil path 53. The oil increased in temperature by heat exchange with the motor 101 passes through the motor-use oil return pipe 111 and is returned to the internal combustion engine 100. Further, the oil discharged from the high temperature side oil pump 42 of the internal combustion engine 100 passes through the PCU-use oil supply pipe 112 and is supplied to the fourth heating oil path 54. The oil increased in temperature by heat exchange with the PCU 104 passes through the PCU-use oil return pipe 113 and is returned to the internal combustion engine 100.

Note that, in the example shown in FIG. 3, oil are separately supplied from the internal combustion engine 100 to the third heating oil path 53 and the fourth heating oil path 54, but the third heating oil path 53 and the fourth heating oil path 54 may be connected by a connecting pipe. In this case, for example, oil flows from the internal combustion engine 100 to the oil supply pipe, third heating oil path 53, connecting pipe, fourth heating oil path 54, and oil return pipe to the internal combustion engine 100 in that order. Further, just one of the third heating oil path 53 and the fourth heating oil path 54 may be used as the heating part 44.

Note that, the heating part 44 may be configured as other than the first heating oil paths 51 to the fourth heating oil path 54 so long as promoting the rise in temperature of the oil while the internal combustion engine 100 is warming up. For example, the heating part 44 may be a heater generating heat by electric power supplied from a battery. In this case, the heating part 44 may be arranged inside the high temperature side oil pan 41 and the oil in the high temperature side oil pan 41 may be directly supplied to the high temperature side parts supplied with oil 43 by the high temperature side oil pump 42. Further, the high temperature side oil circulation path 40 may be provided with a plurality of heating parts 44 (for example, the first heating oil paths 51 and the second heating oil paths 52).

The oil heated by the heating part 44 is supplied to the high temperature side parts supplied with oil 43. In the high temperature side high pressure oil path 45 between the high temperature side oil pump 42 and the high temperature side parts supplied with oil 43, high pressure oil increased in pressure by the high temperature side oil pump 42 flows. Further, the high temperature side high pressure oil path 45 other than the heating part 44 is preferably insulated from the surroundings by a plastic or other insulating material so as to keep the temperature of the oil from falling.

The oil supplied to the high temperature side parts supplied with oil 43 is opened to the atmosphere and drips down to the high temperature side oil pan 41 due to gravity. Therefore, oil supplied from the high temperature side oil pan 41 to the high temperature side parts supplied with oil 43 is again returned to the high temperature side oil pan 41. Note that, the high temperature side high pressure oil path 45 may be provided with a high temperature side oil filter removing minute foreign matter in the oil.

In the present embodiment, in the internal combustion engine 100, the high temperature side oil circulation path 40 is provided separately from the low temperature side oil circulation path 30. For this reason, an amount of oil smaller than the amount of oil as a whole is held inside the high temperature side oil circulation path 40, so the oil heated in the heating part 44 can be used to make the oil in the high temperature side oil circulation path 40 quickly rise in temperature. Further, the oil supplied to the low temperature side parts supplied with oil 33 is not returned to the high temperature side oil pan 41, so the temperature of the oil in the high temperature side oil circulation path 40 can be prevented from falling due to the oil not passing through the heating part 44. As a result, the rise in temperature of the oil in the high temperature side oil circulation path 40 is promoted.

Further, in the present embodiment, the high temperature side oil circulation path 40 is configured so that oil circulates through the high temperature side oil pan 41, heating part 44, and high temperature side parts supplied with oil 43 in that order. That is, in the high temperature side oil circulation path 40, oil is directly supplied from the heating part 44 to the high temperature side parts supplied with oil 43. Due to this, oil of the highest temperature in the high temperature side oil circulation path 40 is supplied to the high temperature side parts supplied with oil 43, so oil supplied to the high temperature side parts supplied with oil 43 can be made to quickly rise in temperature.

Figure 4:
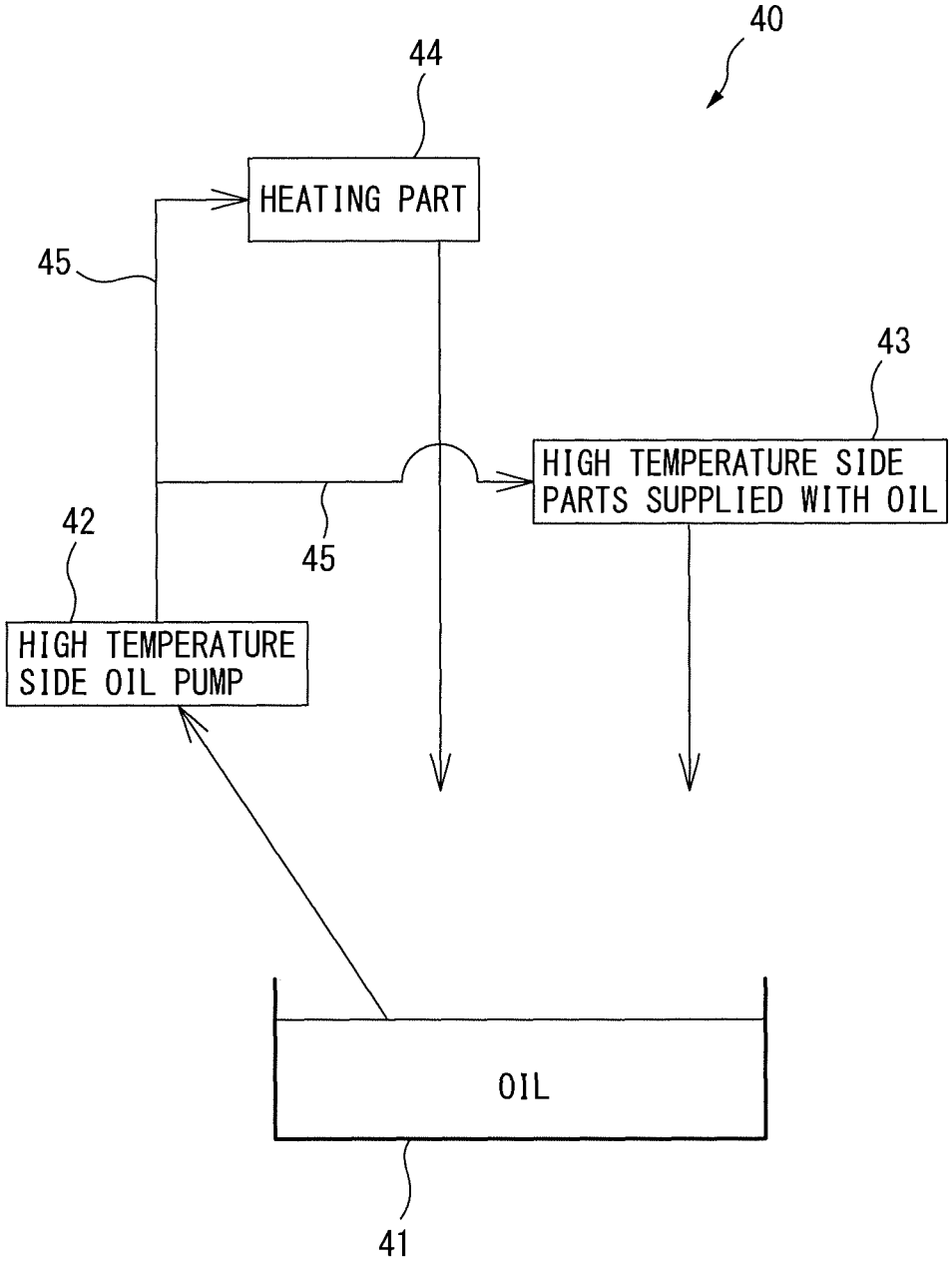
FIG. 4 is a view showing an example of another configuration of a high temperature side oil circulation path.

However, the oil in the high temperature side oil circulation path 40 does not necessarily have to circulate in the above order. For example, oil may circulate through the high temperature side oil pan 41, high temperature side parts supplied with oil 43, and heating part 44 in that order. Further, as shown in FIG. 4, the high temperature side oil circulation path 40 may be configured so that the oil passing through the heating part 44 is directly returned to the high temperature side oil pan 41 and the oil in the high temperature side oil pan 41 is directly supplied by the high temperature side oil pump 42 to the high temperature side parts supplied with oil 43.

As explained above, the oil circulation paths are provided with parts to which oil is supplied, that is, the parts supplied with oil. The parts supplied with oil are components lubricated by oil, components cooled by oil, components operating by oil, etc. The high temperature side parts supplied with oil 43 and low temperature side parts supplied with oil 33 are selected from the parts supplied with oil for example in the following way.

Figure 5:
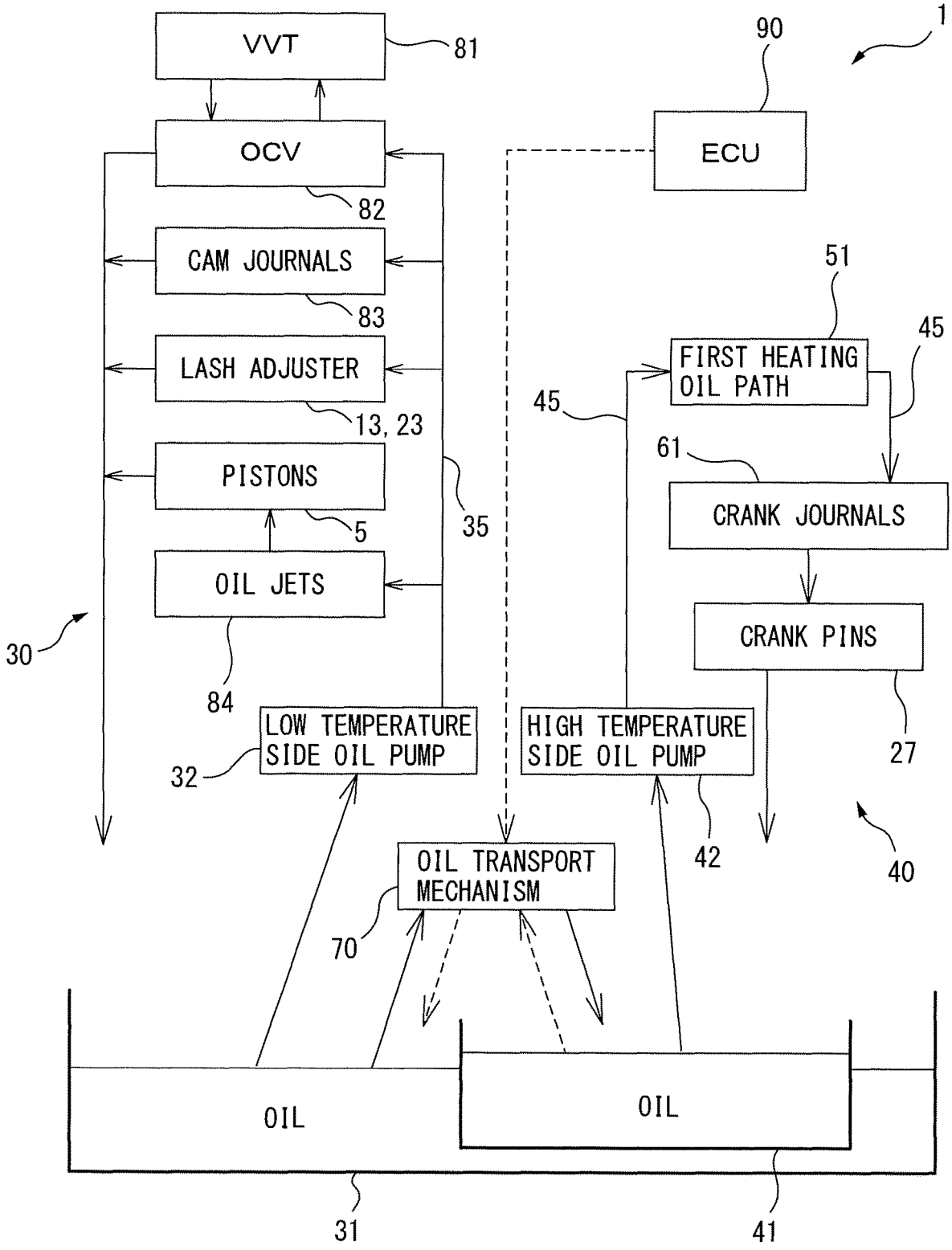
FIG. 5 is a view showing a specific example of the configuration of an oil circulation system.

In the oil circulation system 1 provided in the internal combustion engine 100 shown in FIG. 1, the parts supplied with oil include the crank journals 61, crank pins 27, VVT system 81, cam journals 83, lash adjusters 13 and 23, and pistons 5. FIG. 5 is a view showing a specific example of the configuration of the oil circulation system 1. In the example of FIG. 5, the heating part 44 comprises the first heating oil path 51 formed in the vicinities of the exhaust ports 20.

As explained above, the crank journals 61 are supported inside bearings formed in the cylinder block 3 and rotate inside the bearings. In the crank journals 61 being the parts supplied with oil, oil is supplied between the crank journals 61 and the bearings formed in the cylinder block 3. The bearings are sliding bearings, so due to the supplied oil, the crank journals 61 and bearings are lubricated by fluid lubrication. Due to this, the frictional resistance is decreased.

The crank pins 27 are supported inside bearings formed at the lower side end parts of the connecting rods 28 and are made to turn inside the bearings. In the crank pins 27 being the parts supplied with oil, oil is supplied between the crank pins 27 and the bearings formed at the connecting rods 28. These bearings are also sliding bearings, so due to the supplied oil, the crank pins 27 and bearings are lubricated by fluid lubrication. Due to this, the frictional resistance is decreased.

In the VVT system 81, oil is used as hydraulic fluid. When one hydraulic chamber of the VVT system 81 is supplied with oil, the intake camshaft 15 turns to the advanced side with respect to the intake cam pulley and therefore the valve timings of the intake valves 11 are made to advance. On the other hand, when oil is supplied to the other hydraulic chamber of the VVT system 81, the intake camshaft 15 turns to the delayed side with respect to the intake cam pulley and therefore the valve timings of the intake valves 11 are delayed. The supply of oil to the hydraulic chambers of the VVT system 81 is controlled by the OCV 82. Therefore, the oil supplied to the OCV 82 is used to drive the VVT system 81 being the part supplied with oil.

The cam journals 83 include intake cam journals formed at the intake camshaft 15 and exhaust cam journals formed at the exhaust camshaft 25. As explained above, the cam journals 83 are supported by bearings formed at the cylinder head 4 and rotate inside the bearings. In the cam journals 83 being parts supplied with oil, oil is supplied between the cam journals 83 and the bearings formed at the cylinder head 4. These bearings are also sliding bearings, so due to the supplied oil, the cam journals 83 and bearings are lubricated by fluid lubrication. Due to this, the frictional resistance is decreased.

In the intake lash adjusters 13, oil is used as a hydraulic fluid. When a valve clearance is formed between the intake rocker arms 12 and the intake cams 14, the supplied oil pushes the intake lash adjusters 13 to extend. Similarly, in the exhaust lash adjusters 23, oil is used as a hydraulic fluid. When a valve clearance is formed between the exhaust rocker arms 22 and the exhaust cams 24, the supplied oil pushes the exhaust lash adjusters 23 to extend.

As shown in FIG. 1, the oil jets 84 are attached to the cylinder block 3 below the cylinders and eject oil toward the insides of the pistons 5. The oil ejected from the oil jets 84 cools the pistons 5 and is supplied between the piston pins 29 and the bearings formed at the upper side end parts of the connecting rods 28. These bearings are also sliding bearings, so due to the supplied oil, the piston pins 29 and bearings are lubricated by fluid lubrication. Due to this, the frictional resistance is decreased.

Further, during reciprocating motion of the pistons 5, the pistons 5 swing about the piston pins 29 inside the cylinders. As a result, during reciprocating motion of the pistons 5, the piston skirts 5*a* of the pistons 5 and the cylinder wall surfaces slide against each other in a contacting state. The oil ejected from the oil jets 84 sticks to the wall surfaces of the cylinders as well, so oil is supplied between the wall surfaces of the cylinders and the piston skirts 5*a*. Therefore, due to the supplied oil, the piston skirts 5*a* of the pistons 5 and the cylinder wall surfaces are lubricated by fluid lubrication. Due to this, the frictional resistance is decreased.

In structural members lubricated by fluid lubrication such as structural members having sliding bearings, if the supplied oil is low in temperature and the oil is high in viscosity, the mechanical resistance increases and the internal combustion engine 100 deteriorates in fuel efficiency. For this reason, in order to improve the fuel efficiency of the internal combustion engine 100, when the internal combustion engine 100 is started cold etc., the oil supplied to the structural members lubricated by fluid lubrication has to be made to quickly rise in temperature.

For this reason, the high temperature side parts supplied with oil 43 include at least a part of the structural members lubricated by fluid lubrication, for example, at least a part of the structural members having sliding bearings. The components lubricated by fluid lubrication comprise the crank journals 61, crank pins 27, cam journals 83, pistons 5 (piston skirts 5*a*), etc.

In the example shown in FIG. 5, the high temperature side parts supplied with oil 43 include the crank journals 61 and crank pins 27. The crank journals 61 receive particularly large loads among the components lubricated by fluid lubrication. For this reason, by making the oil supplied to the crank journals 61 rise in temperature quickly to reduce the mechanical resistance, it is possible to obtain a remarkable effect of improvement of the fuel efficiency. Further, by making only a part of the components lubricated by fluid lubrication high temperature side parts supplied with oil 43, it is possible to further reduce the amount of oil in the high temperature side oil circulation path 40 and possible to promote the rise in temperature of the oil in the high temperature side oil circulation path 40.

The low temperature side parts supplied with oil 33 include parts supplied with oil not included in the high temperature side parts supplied with oil 43. In the example shown in FIG. 5, the low temperature side parts supplied with oil 33 include the VVT system 81, cam journals 83, lash adjusters 13, 23, and pistons 5.

Note that, the high temperature side parts supplied with oil 43 may also include cam journals 83 and piston skirts 5*a* (pistons 5) which are lubricated by fluid lubrication. Further, the balance shafts and turbocharger also have sliding bearings and are parts supplied with oil which are lubricated by fluid lubrication. For this reason, if the internal combustion engine 100 is provided with balance shafts, the high temperature side parts supplied with oil 43 may also include the balance shafts. Similarly, if the internal combustion engine 100 is provided with a turbocharger, the high temperature side parts supplied with oil 43 may also include a turbocharger.

As explained above, in the present embodiment, if the internal combustion engine 100 is started up cold etc., it is possible to make the temperature of the oil supplied to the high temperature side parts supplied with oil 43 quickly rise. However, after the internal combustion engine 100 warms up, the temperature of the oil in the high temperature side oil circulation path 40 excessively rises and oil is liable to be burnt etc. Further, oil moves when the vehicle in which the internal combustion engine 100 is provided is turning etc., whereby the oil in the low temperature side oil circulation path 30 or high temperature side oil circulation path 40 is liable to become insufficient. Therefore, the oil in the low temperature side oil circulation path 30 or high temperature side oil circulation path 40 is liable to degrade in condition.

In the present embodiment, the oil circulation system 1 comprises the oil transport mechanism 70 transporting oil between the low temperature side oil circulation path 30 and the high temperature side oil circulation path 40, and a control device controlling the transport of oil by the oil transport mechanism 70 during operation of the internal combustion engine 100. Due to this, it is possible to transport oil between the low temperature side oil circulation path 30 and the high temperature side oil circulation path 40 as needed even while the internal combustion engine 100 is operating and in turn possible to keep the oil inside the low temperature side oil circulation path 30 or high temperature side oil circulation path 40 from degrading in condition. Note that, in the present embodiment, as the control device, an electronic control unit (ECU) 90 is used.

The ECU 90 is a microcomputer comprising a central processing unit (CPU), read only memory (ROM) and random access memory (RAM) or other such memory, an input port, an output port, etc. The ECU 90 controls the various actuators of the internal combustion engine 100 based on the output of the various types of sensors. In the present embodiment, a single ECU 90 is provided, but a plurality of ECUs may be provided for the individual functions.

For example, the ECU 90 stops the transport of oil while the internal combustion engine 100 is warming up and uses the oil transport mechanism 70 to transport oil from the low temperature side oil circulation path 30 to the high temperature side oil circulation path 40 after the internal combustion engine 100 has warmed up. Due to this, it is possible to make the oil in the high temperature side oil circulation path 40 quickly rise in temperature while the internal combustion engine 100 is warming up and possible to keep the temperature of the oil in the high temperature side oil circulation path 40 from excessively rising after the internal combustion engine has warmed up. The transport of the oil after the internal combustion engine 100 has warmed up is for example performed at predetermined intervals. Further, the internal combustion engine 100 having finished warming up is judged based on the elapsed time etc., from when the internal combustion engine 100 was started up cold.

Further, a liquid surface sensor (not shown) detecting the level of the liquid surface of the oil in the oil pan (height of oil surface) may be provided at least at one of the low temperature side oil pan 31 and high temperature side oil pan 41. In this case, the ECU 90 uses the oil transport mechanism 70 to transport oil between the low temperature side oil circulation path 30 and high temperature side oil circulation path 40 based on the level of the liquid surface detected by the liquid surface sensor.

For example, the ECU 90 uses the oil transport mechanism 70 to transport oil from the high temperature side oil circulation path 40 to the low temperature side oil circulation path 30 when the level of the liquid surface detected by the liquid surface sensor provided at the low temperature side oil pan 31 is equal to or less than the first reference value. Similarly, the ECU 90 uses the oil transport mechanism 70 to transport oil from the low temperature side oil circulation path 30 to the high temperature side oil circulation path 40 when the level of the liquid surface detected by the liquid surface sensor provided in the high temperature side oil pan 41 is equal to or less than the first reference value. Further, the ECU 90 may use the oil transport mechanism 70 to transport oil from the low temperature side oil circulation path 30 to the high temperature side oil circulation path 40 when the level of the liquid surface detected by the liquid surface sensor provided in the low temperature side oil pan 31 is equal to or greater than a second reference value. Similarly, the ECU 90 may use the oil transport mechanism 70 to transport oil from the high temperature side oil circulation path 40 to the low temperature side oil circulation path 30 when the level of the liquid surface detected by the liquid surface sensor provided in the high temperature side oil pan 41 is equal to or greater than the second reference value. The first reference value and the second reference value are predetermined. The second reference value is a value higher than the first reference value.

Figure 6:
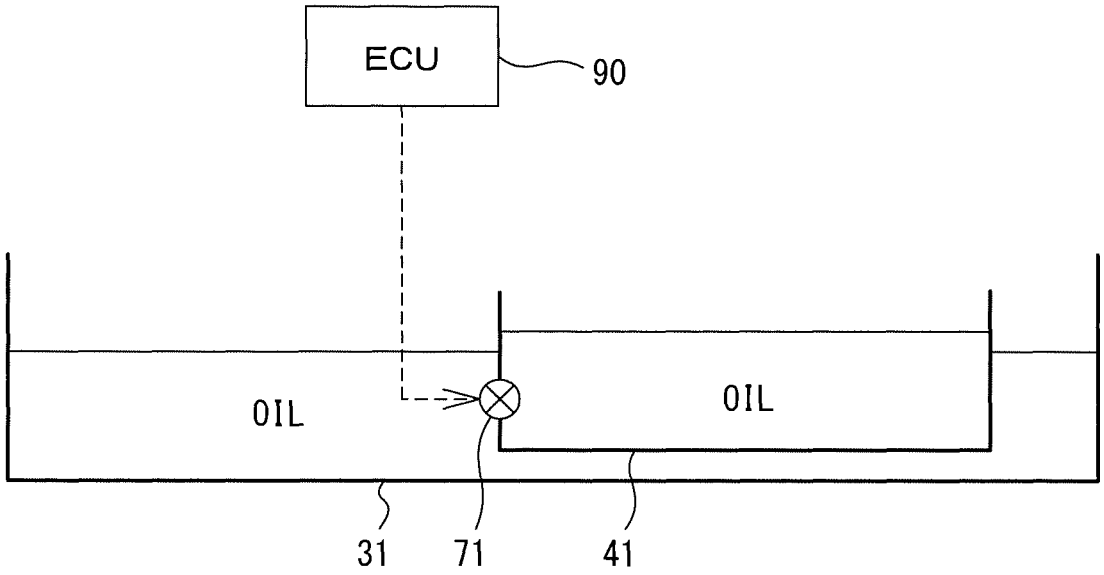
FIG. 6 is a view schematically showing a specific example of an oil transport mechanism.

FIG. 6 to FIG. 9 are views schematically showing a specific example of the oil transport mechanism 70. In the example of FIG. 6, the oil transport mechanism 70 comprises a first shutoff valve 71 which opens and closes an opening provided in the high temperature side oil pan 41 so that the inside of the high temperature side oil pan 41 and the inside of the low temperature side oil pan 31 are communicated. The first shutoff valve 71 is opened and closed by the ECU 90 and is configured to permit the movement of oil from the low temperature side oil pan 31 to the high temperature side oil pan 41 and stop movement of oil from the high temperature side oil pan 41 to the low temperature side oil pan 31.

Note that, the first shutoff valve 71 may be configured to permit movement of oil from the high temperature side oil pan 41 to the low temperature side oil pan 31 and stop movement of oil from the low temperature side oil pan 31 to the high temperature side oil pan 41. Further, two first shutoff valves 71 may be provided, one shutoff valve may be configured to permit the movement of oil from the low temperature side oil pan 31 to the high temperature side oil pan 41 and stop movement of oil from the high temperature side oil pan 41 to the low temperature side oil pan 31, and the other shutoff valve may be configured to permit movement of oil from the high temperature side oil pan 41 to the low temperature side oil pan 31 and stop movement of oil from the low temperature side oil pan 31 to the high temperature side oil pan 41. Further, the oil transport mechanism 70 may comprise an oil path connecting the high temperature side oil pan 41 and the low temperature side oil pan 31 and a shutoff valve provided in the connecting oil path so as to open and close the connecting oil path.

Figure 7:
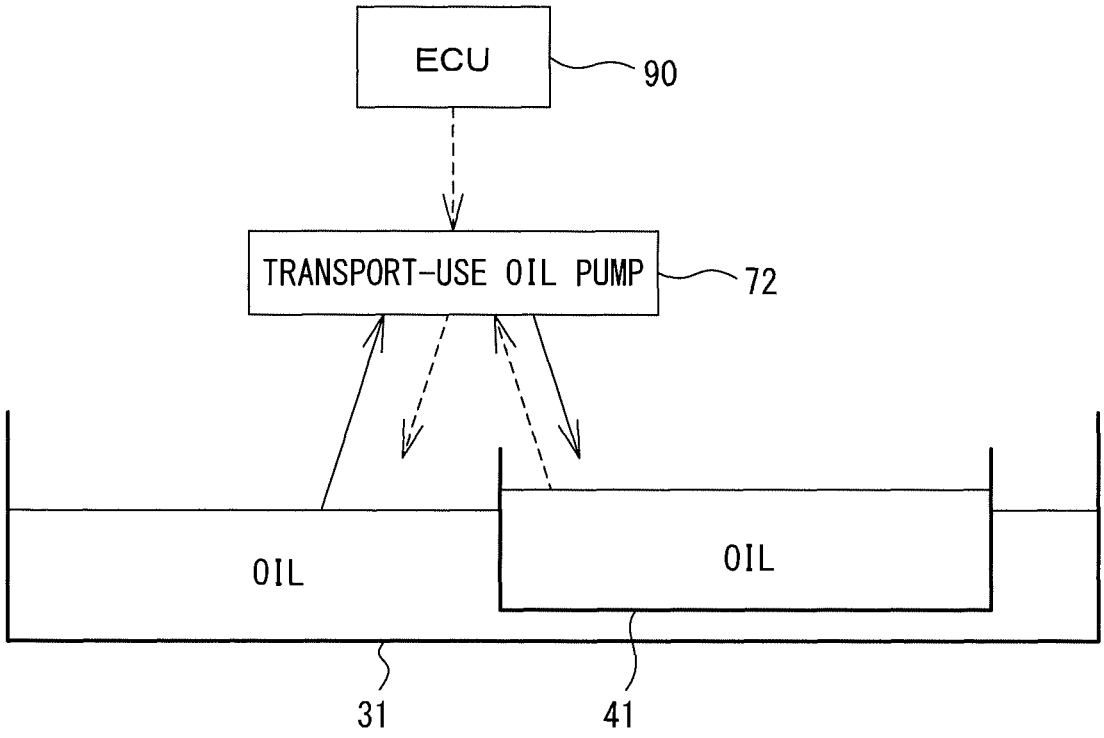
FIG. 7 is a view schematically showing a specific example of an oil transport mechanism.

In the example of FIG. 7, the oil transport mechanism 70 comprises a transport-use oil pump 72. The transport-use oil pump 72 is actuated by the ECU 90 and is configured to pump up the oil in the low temperature side oil pan 31 and discharge it toward the high temperature side oil pan 41. Note that, as shown by the broken line in FIG. 7, the transport-use oil pump 72 may be configured to pump up the oil inside the high temperature side oil pan 41 and discharge it toward the low temperature side oil pan 31. Further, two transport-use oil pumps 72 may be provided, one oil pump may be configured to pump up oil in the low temperature side oil pan 31 and discharge it toward the high temperature side oil pan 41, and the other oil pump may be configured to pump up oil in the high temperature side oil pan 41 and discharge it toward the low temperature side oil pan 31. Further, the oil pumped up by the transport-use oil pump 72 may be supplied to other parts of the low temperature side oil circulation path 30 or high temperature side oil circulation path 40.

Figure 8:
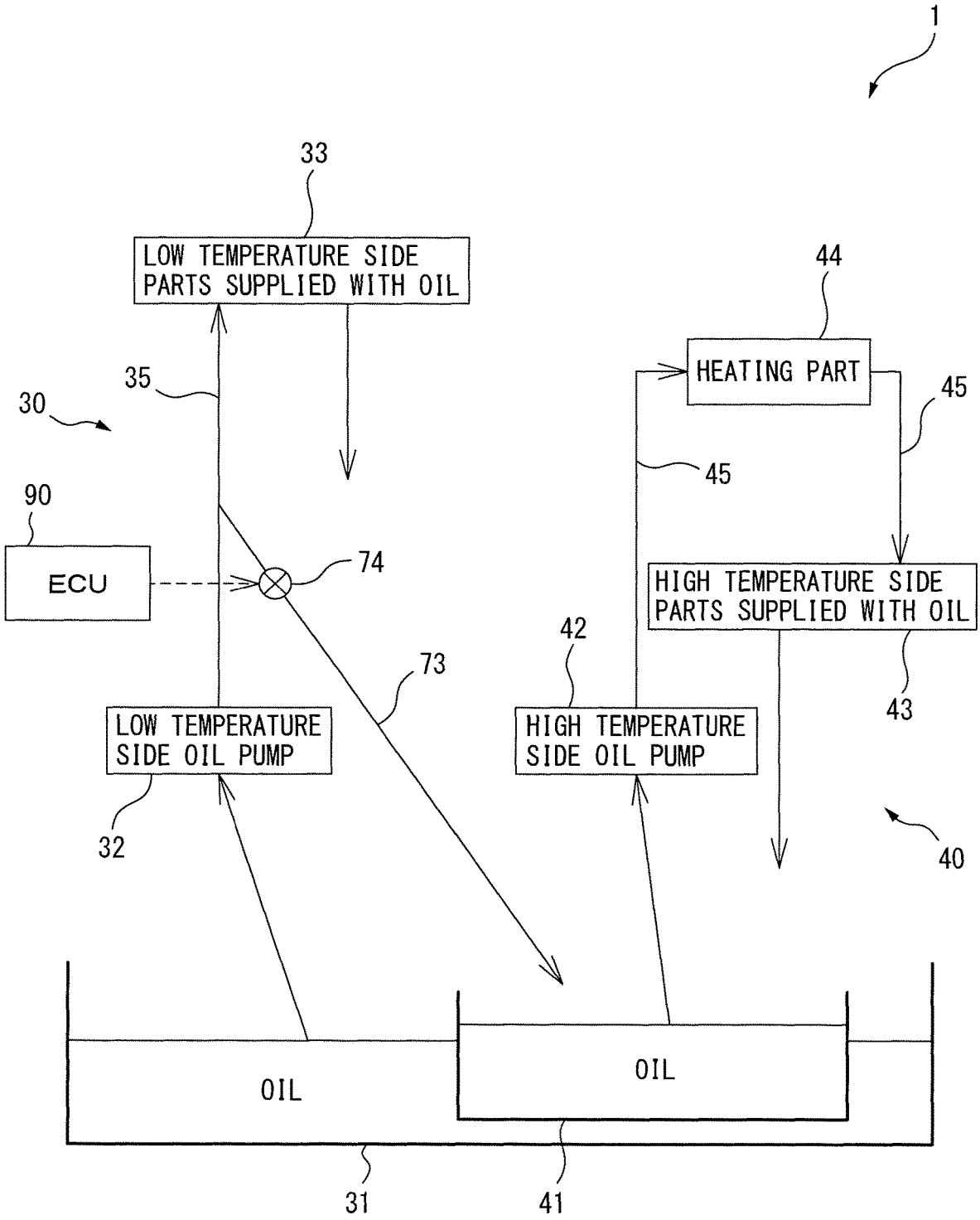
FIG. 8 is a view schematically showing a specific example of an oil transport mechanism.

In the example of FIG. 8, the oil transport mechanism 70 comprises a transport oil path 73 guiding a part of the oil supplied by the low temperature side oil pump 32 to the high temperature side oil pan 41, and a second shutoff valve 74 provided at the transport oil path 73 so as to open and close the transport oil path 73. The transport oil path 73 is connected to the low temperature side high pressure oil path 35. In the transport oil path 73, high pressure oil increased in pressure by the low temperature side oil pump 32 flows. The second shutoff valve 74 is opened and closed by the ECU 90 and is configured to permit the movement of oil from the low temperature side oil circulation path 30 to the high temperature side oil pan 41 and stop the movement of oil from the high temperature side oil pan 41 to the low temperature side oil circulation path 30.

Note that, the transport oil path 73 may be connected to the high temperature side high pressure oil path 45 so that a part of the oil supplied by the high temperature side oil pump 42 is guided to the low temperature side oil pan 31. In this case, the second shutoff valve 74 is configured to permit the movement of oil from the high temperature side oil circulation path 40 to the low temperature side oil pan 31 and stop the movement of oil from the low temperature side oil pan 31 to the high temperature side oil circulation path 40. Further, the transport oil path 73 may be comprises a first transport oil path connected to the low temperature side high pressure oil path 35 so as to guide a part of the oil supplied by the low temperature side oil pump 32 to the high temperature side oil pan 41, and a second transport oil path connected to the high temperature side high pressure oil path 45 so as to guide a part of the oil supplied by the high temperature side oil pump 42 to the low temperature side oil pan 31. Further, the oil passing through the transport oil path 73 may be supplied to the other part of the low temperature side oil circulation path 30 or high temperature side oil circulation path 40.

Figure 9:
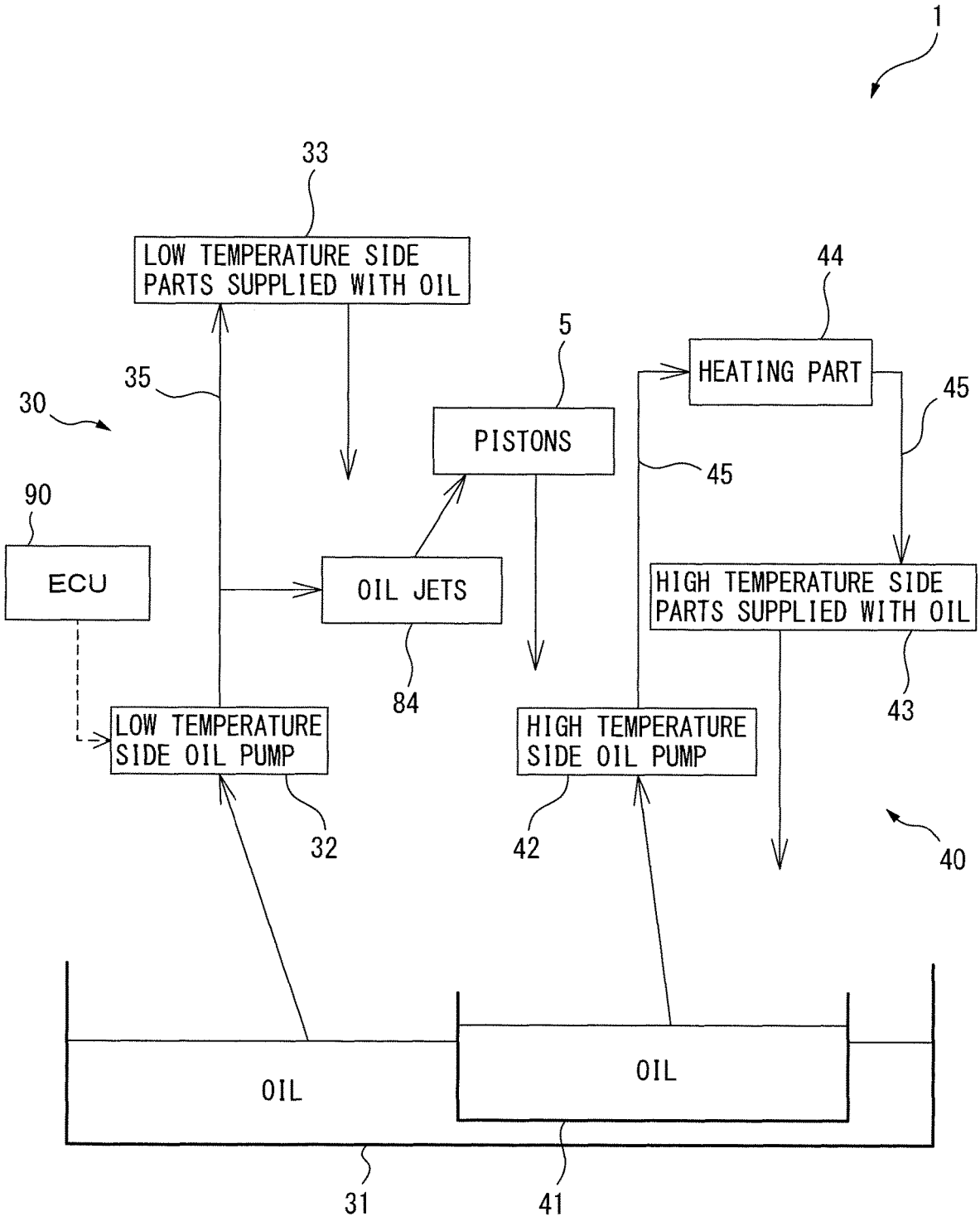
FIG. 9 is a view schematically showing a specific example of an oil transport mechanism.

In the example of FIG. 9, the oil transport mechanism 70 comprises oil jets 84. The oil jets 84 are provided in the low temperature side oil circulation path 30. Due to the low temperature side oil pump 32, oil in the low temperature side oil pan 31 is supplied. In this example, the high temperature side oil pan 41 is configured to recover oil ejected by the oil jets 84. Specifically, the high temperature side oil pan 41 is arranged at a position where oil ejected from the oil jets 84 toward the pistons 5 drip down due to gravity. Therefore, the oil jets 84 transport oil from the low temperature side oil circulation path 30 to the high temperature side oil circulation path 40.

In the example of FIG. 9, by providing a check valve opening at equal to or greater than predetermined pressures of hydraulic pressures at the upstream sides of the oil jets 84 and controlling the amount of discharge of the low temperature side oil pump 32 by the ECU 90, it is possible to control the ejection of oil from the oil jets 84. In this case, the low temperature side oil pump 32 is a variable capacity oil pump. Note that, the oil jets 84 may be electronic control type injectors controlled in oil ejection by the ECU 90. By ejecting oil from the oil jets 84 such as in the example of FIG. 9, it is possible to transport oil from the low temperature side oil circulation path 30 to the high temperature side oil circulation path 40 without using additional components such as shown in FIG. 6 to FIG. 8. Note that, it is possible to use the oil jets 84 as the oil transport mechanism 70 regardless of the cylinder array of the internal combustion engine such as in-line, horizontally opposed, etc.

Note that, the oil jets 84 may be provided in the high temperature side oil circulation path 40 and supplied with the oil in the high temperature side oil pan 41 by the high temperature side oil pump 42. In this case, the low temperature side oil pan 31 is configured to recover oil ejected from the oil jets 84. That is, the oil jets 84 may transport oil from the high temperature side oil circulation path 40 to the low temperature side oil circulation path 30.

Further, when the internal combustion engine 100 is stopped, the operations of the high temperature side oil pump 42 and low temperature side oil pump 32 are also stopped. As a result, oil in the high temperature side oil circulation path 40 is returned to the high temperature side oil pan 41, while oil in the low temperature side oil circulation path 30 is returned to the low temperature side oil pan 31.

In the present embodiment, if the oil transport mechanism 70 transports oil from the low temperature side oil circulation path 30 to the high temperature side oil circulation path 40, the high temperature side oil pan 41 and low temperature side oil pan 31 are configured so that when the internal combustion engine 100 is stopped, the oil in the high temperature side oil pan 41 moves into the low temperature side oil pan 31. Due to this, it is possible to keep only specific oil from receiving a thermal load in the high temperature side oil circulation path 40 and possible to disperse the thermal load in the oil as a whole. As a result, it is possible to keep the oil from degrading. For example, the high temperature side oil pan 41 and low temperature side oil pan 31 are configured so that when the internal combustion engine 100 is stopped and oil is returned to the high temperature side oil pan 41, the oil in the high temperature side oil pan 41 will ride over the peripheral walls of the high temperature side oil pan 41 and move into the low temperature side oil pan 31.

Note that, the high temperature side oil pan 41 and low temperature side oil pan 31 may be configured so that when the internal combustion engine 100 is stopped, the oil in the high temperature side oil pan 41 and the oil in the low temperature side oil pan 31 are mixed. By this as well, it is possible to disperse the thermal load in the oil as a whole. For example, the high temperature side oil pan 41 and low temperature side oil pan 31 are configured so that when the internal combustion engine 100 is stopped and oil is returned to the low temperature side oil pan 31 and high temperature side oil pan 41, the oil in the low temperature side oil pan 31 and the high temperature side oil pan 41 rides over the peripheral walls of the high temperature side oil pan 41.

Further, the high temperature side oil pan 41 and low temperature side oil pan 31 are configured so that when the amount of the oil in the high temperature side oil pan 41 becomes equal to or greater than a predetermined amount while the internal combustion engine 100 is operating, the oil in the high temperature side oil pan 41 moves into the low temperature side oil pan 31. For example, the high temperature side oil pan 41 and low temperature side oil pan 31 are configured so that when, due to transport of the oil, the amount of the oil in the high temperature side oil pan 41 becomes equal to or greater than a predetermined amount, the oil in the high temperature side oil pan 41 rides over the peripheral walls of the high temperature side oil pan 41 and moves into the low temperature side oil pan 31. By doing this, it is possible to keep movement of oil from the low temperature side oil circulation path 30 to the high temperature side oil circulation path 40 from causing the oil in the low temperature side oil circulation path 30 to become insufficient. Note that, the oil transport mechanism 70 may be configured by combining the means such as shown in FIG. 6 to FIG. 9.

Second Embodiment

The oil circulation system of an internal combustion engine according to the second embodiment, except for the points explained below, basically is the same as the oil circulation system of the internal combustion engine according to the first embodiment in configuration and control. For this reason, below, the second embodiment of the present invention will be explained focusing on parts different from the first embodiment.

Figure 10:
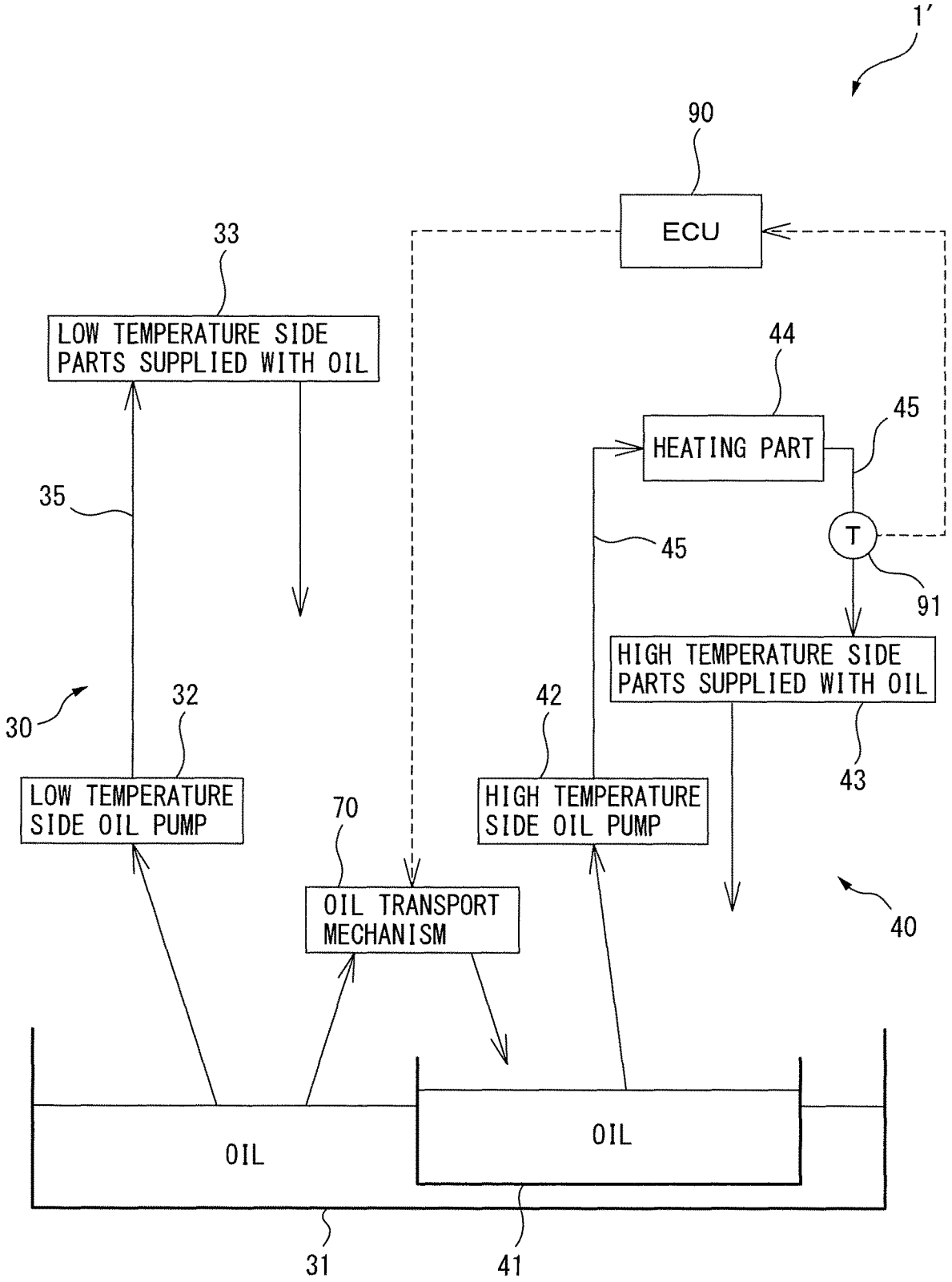
FIG. 10 is a view schematically showing the configuration of an oil circulation system of an internal combustion engine according to a second embodiment of the present invention.

FIG. 10 is a view schematically showing the configuration of an oil circulation system 1' of an internal combustion engine according to the second embodiment of the present invention. The oil circulation system 1' further comprises a high temperature side oil temperature sensor 91 detecting the temperature of the oil in the high temperature side oil circulation path 40. The high temperature side oil temperature sensor 91 is provided in the high temperature side oil circulation path 40. The output of the high temperature side oil temperature sensor 91 is transmitted to the ECU 90 and input to the input port of the ECU 90.

In the second embodiment, the ECU 90 uses the oil transport mechanism 70 to transport the oil from the low temperature side oil circulation path 30 to the high temperature side oil circulation path 40 when the temperature of the oil detected by the high temperature side oil temperature sensor 91 is equal to or greater than the first temperature. The first temperature is determined in advance so that the oil is not burnt etc., in the high temperature side oil circulation path 40. If oil is transported from the low temperature side oil circulation path 30 to the high temperature side oil circulation path 40, the temperature of the oil in the high temperature side oil circulation path 40 falls. In the above-mentioned control, the transport of oil is controlled based on the output of the high temperature side oil temperature sensor 91, so the temperature of the oil in the high temperature side oil circulation path 40 can be more precisely kept from excessively rising.

In the present embodiment, the high temperature side oil temperature sensor 91 is provided at the high temperature side high pressure oil path 45 between the heating part 44 and the high temperature side parts supplied with oil 43, and detects the temperature of the oil heated by the heating part 44. Due to this, it is possible to control the transport of oil based on the highest temperature of the oil in the high temperature side oil circulation path 40. However, the high temperature side oil temperature sensor 91 may be provided at another position in the high temperature side oil circulation path 40 (between high temperature side oil pump 42 and heating part 44, inside high temperature side oil pan 41, etc.)

<Oil Transport Processing>

Figure 11:
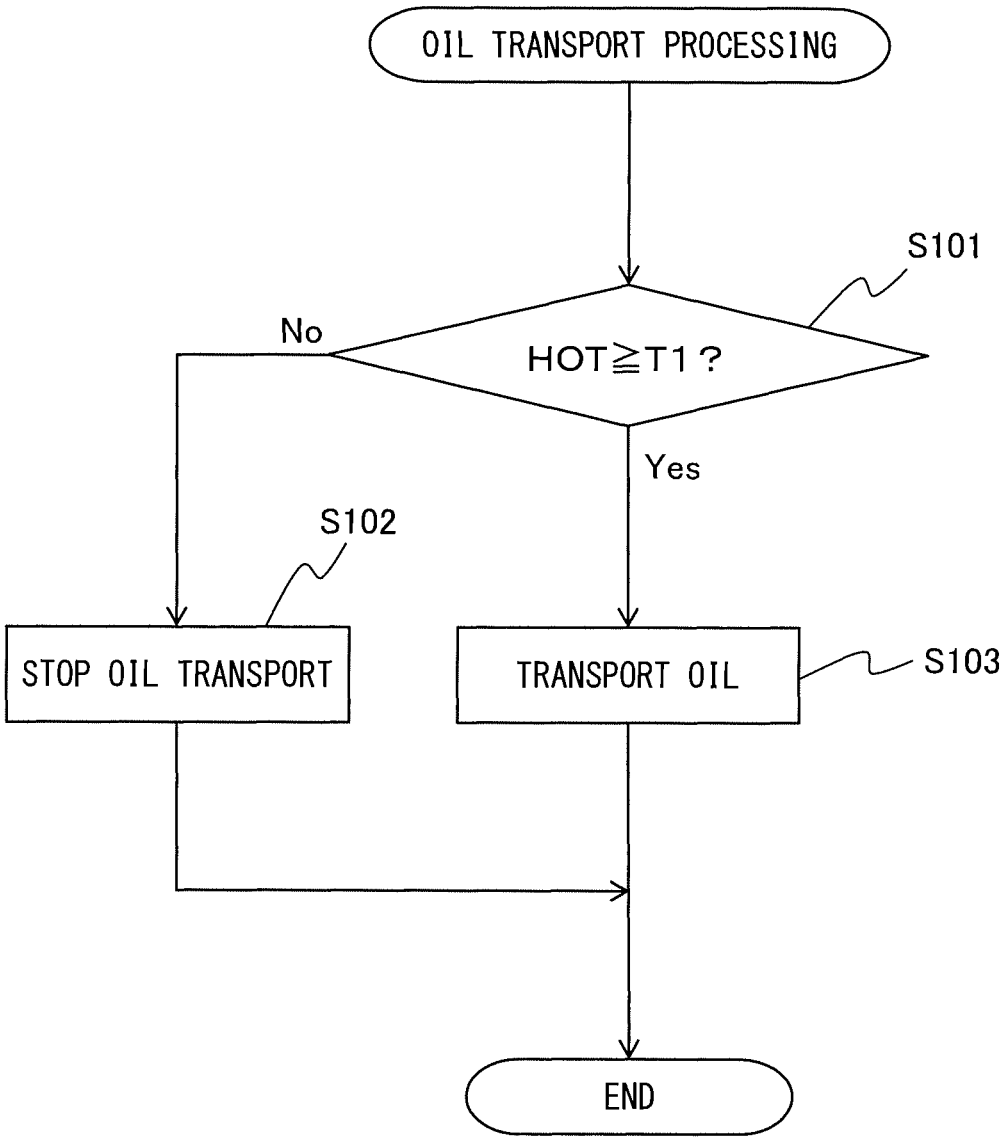
FIG. 11 is a flow chart showing a control routine of oil transport processing in the second embodiment of the present invention.

Below, referring to FIG. 11, control for transporting oil from the low temperature side oil circulation path 30 to the high temperature side oil circulation path 40 in the second embodiment will be explained. FIG. 11 is a flow chart showing a control routine of oil transport processing in the second embodiment of the present invention. The present control routine is executed repeatedly by the ECU 90 at predetermined time intervals after the internal combustion engine 100 is started up.

First, at step S101, it is judged whether the temperature of the oil HOT in the high temperature side oil circulation path 40 is equal to or greater than a predetermined first temperature T1. The temperature of the oil HOT is detected by the high temperature side oil temperature sensor 91. If it is judged that the temperature of the oil HOT is less than the first temperature T1, the present control routine proceeds to step S102. At step S102, transport of oil from the low temperature side oil circulation path 30 to the high temperature side oil circulation path 40 by the oil transport mechanism 70 is stopped. After step S102, the present control routine is ended.

On the other hand, if at step S101 it is judged that the temperature of the oil HOT is equal to or greater than the first temperature T1, the present control routine proceeds to step S103. At step S103, oil is transported by the oil transport mechanism 70 from the low temperature side oil circulation path 30 to the high temperature side oil circulation path 40. After step S103, the present control routine is ended.

<Oil Ejection Processing>

Figure 12:
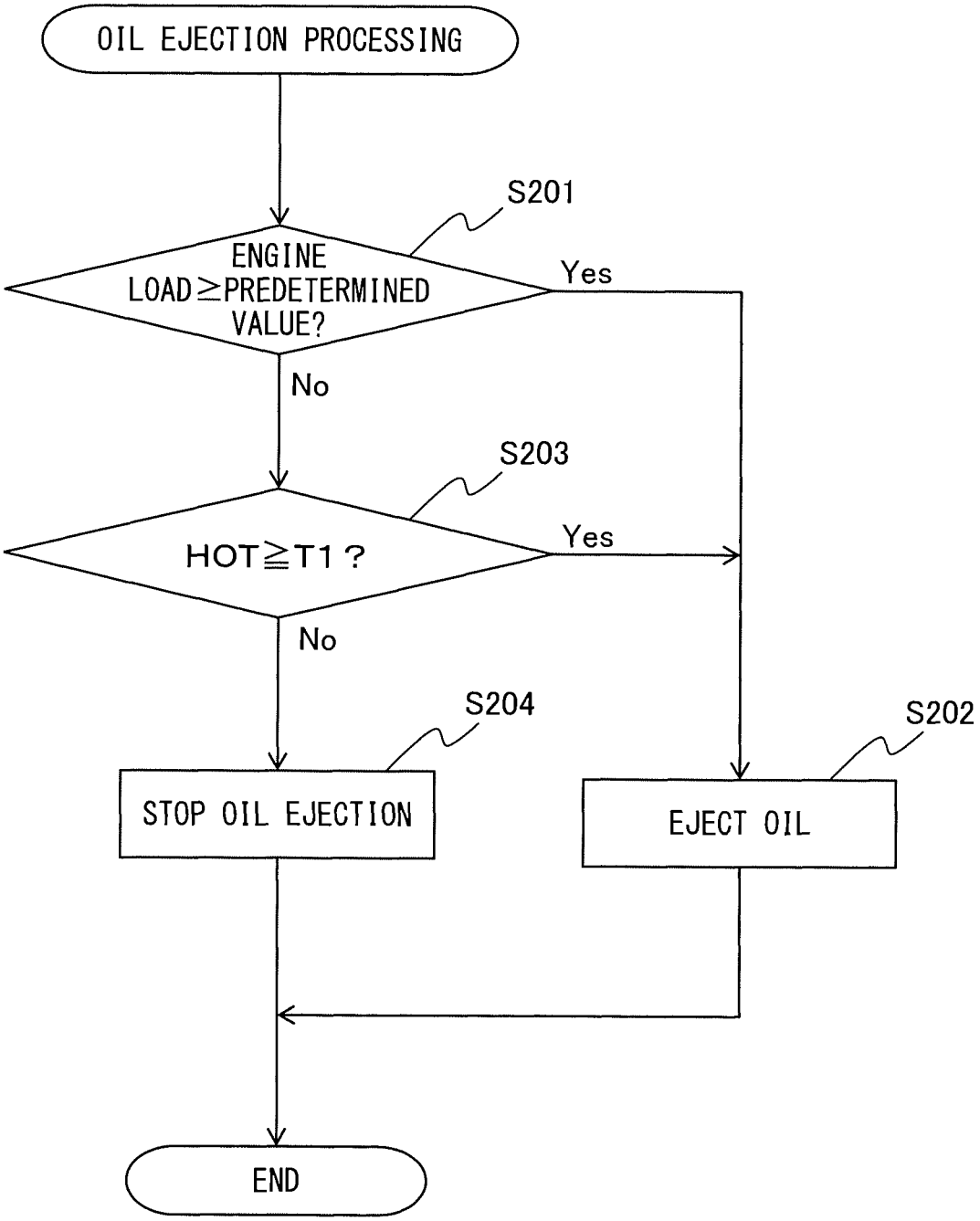
FIG. 12 is a flow chart showing a control routine of oil ejection processing in the second embodiment of the present invention.

Next, the control for ejecting oil from the oil jets 84 when like in the example of FIG. 9, oil jets 84 are used as the oil transport mechanism 70 in the second embodiment will be explained. FIG. 12 is a flow chart showing a control routine of oil ejection processing in the second embodiment of the present invention. The present control routine is executed repeatedly by the ECU 90 at predetermined time intervals after the internal combustion engine 100 is started up.

First, at step S201, it is judged whether the engine load is equal to or greater than a predetermined value. The predetermined value is predetermined, for example, is set to a lower limit value of the engine load where cooling of the pistons 5 etc., is considered required. The engine load is, for example, calculated based on the output of the load sensor. The load sensor is connected to the accelerator pedal provided in the vehicle and detects the amount of depression of the accelerator pedal. The output of the load sensor is transmitted to the ECU 90 and input to the input port of the ECU 90.

If at step S201 it is judged that the engine load is equal to or greater than the predetermined value, the present control routine proceeds to step S202. At step S202, in order to cool the pistons 5 etc., oil is ejected from the oil jets 84. After step S202, the present control routine is ended.

On the other hand, if at step S201 it is judged that the engine load is less than the predetermined value, the present control routine proceeds to step S203. At step S203, it is judged whether the temperature of the oil HOT in the high temperature side oil circulation path 40 is equal to or greater than a predetermined first temperature T1. The temperature of the oil HOT is detected by the high temperature side oil temperature sensor 91. If it is judged that the temperature of the oil HOT is less than the first temperature T1, the present control routine proceeds to step S204. At step S204, the ejection of oil by the oil jet 84 is stopped. After step S204, the present control routine is ended.

On the other hand, if at step S203 it is judged if the temperature of the oil HOT is equal to or greater than the first temperature T1, the present control routine proceeds to step S202. At step S202, in order to lower the temperature of the oil in the high temperature side oil circulation path 40, oil is ejected from the oil jets 84 and oil is transported from the low temperature side oil circulation path 30 to the high temperature side oil circulation path 40. After step S202, the present control routine is ended.

Due to the above-mentioned control, when using oil jets 84 as the oil transport mechanism 70, it is possible to secure the performances of the pistons 5 etc., at the time of engine high load while keeping the temperature of the oil in the high temperature side oil circulation path 40 from excessively rising.

Third Embodiment

The oil circulation system of an internal combustion engine according to the third embodiment, except for the points explained below, basically is the same as the oil circulation system of the internal combustion engine according to the second embodiment in configuration and control. For this reason, below, the third embodiment of the present invention will be explained focusing on parts different from the second embodiment.

Figure 13:
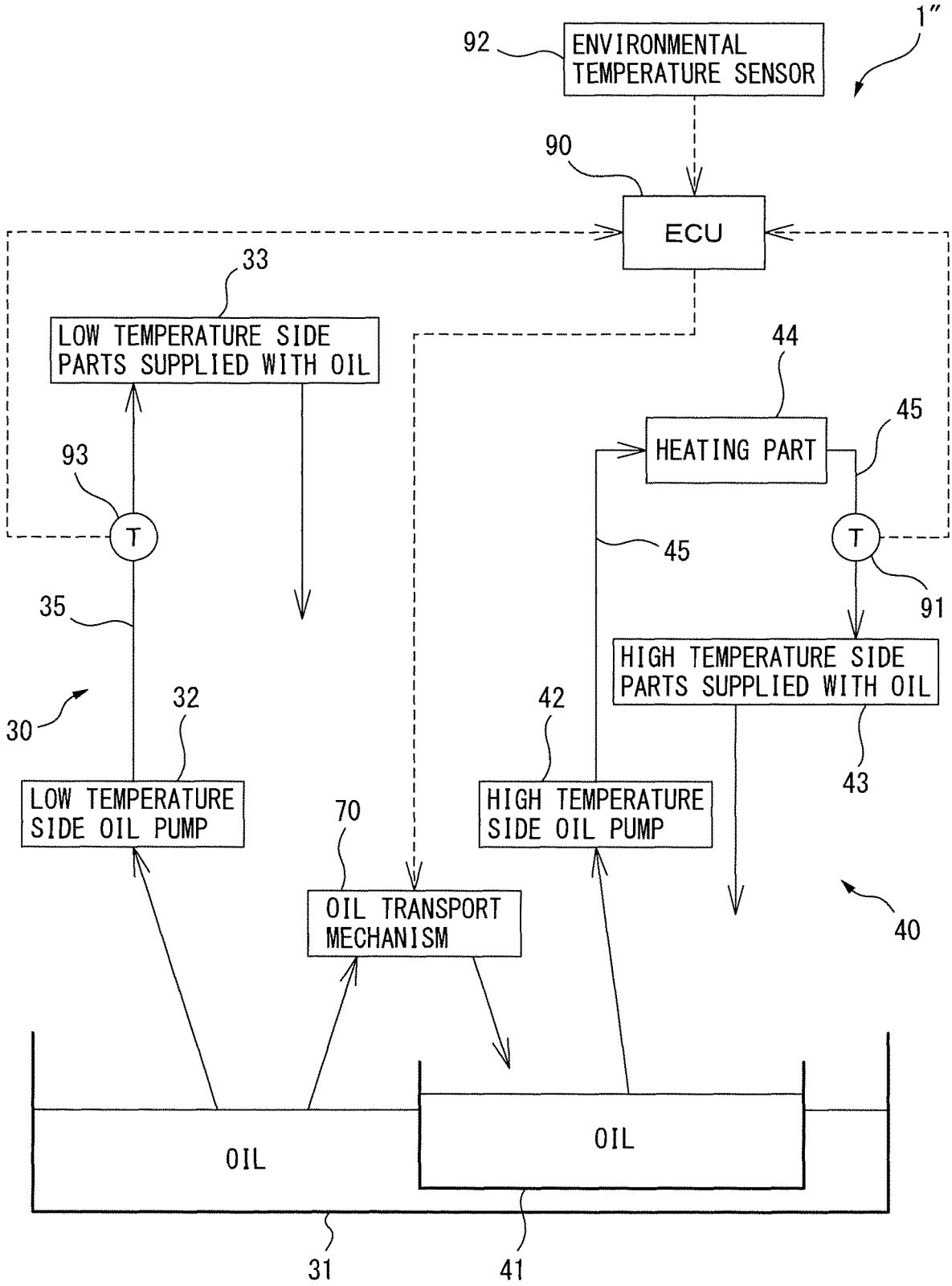
FIG. 13 is a view schematically showing the configuration of an oil circulation system of an internal combustion engine according to a third embodiment of the present invention.

FIG. 13 is a view schematically showing the configuration of an oil circulation system 1" of an internal combustion engine according to the third embodiment of the present invention. The oil circulation system 1" further comprises an environmental temperature sensor 92 detecting an environmental temperature, and a low temperature side oil temperature sensor 93 detecting the temperature of the oil in the low temperature side oil circulation path 30. The environmental temperature sensor 92 is provided at the internal combustion engine 100 or vehicle. The low temperature side oil temperature sensor 93 is provided at the low temperature side oil circulation path 30, specifically at the low temperature side high pressure oil path 35. The outputs of the environmental temperature sensor 92 and low temperature side oil temperature sensor 93 are transmitted to the ECU 90 and input to the input port of the ECU 90. Note that, the low temperature side oil temperature sensor 93 may be provided at another position at the low temperature side oil circulation path 30 (inside of low temperature side oil pan 31 etc.)

As explained above, the high temperature side oil pan 41 and low temperature side oil pan 31 are configured so that when the amount of the oil in the high temperature side oil pan 41 becomes equal to or greater than a predetermined amount, the oil in the high temperature side oil pan 41 moves into the low temperature side oil pan 31. Therefore, if transport of oil by the oil transport mechanism 70 causes the amount of the oil in the high temperature side oil pan 41 to become equal to or greater than a predetermined amount, the oil in the high temperature side oil pan 41 moves into the low temperature side oil pan 31 and the temperature of the oil in the low temperature side oil pan 31 rises.

If the environmental temperature when the internal combustion engine 100 is started up is extremely low, the water mixed into the oil will sometimes freeze and clog the oil strainer. For this reason, if the environmental temperature when the internal combustion engine 100 is started up is extremely low, preferably not only the oil in the high temperature side oil circulation path 40 but also the oil in the low temperature side oil circulation path 30 can be quickly increased in temperature.

Therefore, in the third embodiment, the ECU 90 uses the oil transport mechanism 70 to transport oil from the low temperature side oil circulation path 30 to the high temperature side oil circulation path 40 if the environmental temperature detected by the environmental temperature sensor 92 is equal to or less than the second temperature when the internal combustion engine 100 is started up. The second temperature is predetermined, for example, is 0° C.

Specifically, the ECU 90 uses the oil transport mechanism 70 to transport oil from the low temperature side oil circulation path 30 to the high temperature side oil circulation path 40 until the temperature detected by the low temperature side oil temperature sensor 93 reaches a third temperature if the environmental temperature detected by the environmental temperature sensor 92 is equal to or less than a second temperature when the internal combustion engine 100 is started up. The third temperature is predetermined and is set so that clogging of the oil strainer is eliminated.

Note that, the ECU 90 may use the oil transport mechanism 70 to transport oil from the low temperature side oil circulation path 30 to the high temperature side oil circulation path 40 until a predetermined time elapses from when the internal combustion engine 100 is started up, if the environmental temperature detected by the environmental temperature sensor 92 is equal to or less than the second temperature when the internal combustion engine 100 is started up. The predetermined time is predetermined, for example, is set to the time required for the internal combustion engine 100 to warm up if the environmental temperature is equal to or lower than the second temperature. In this case, the low temperature side oil temperature sensor 93 may be omitted from the oil circulation system 1.

Further, the oil in the high temperature side oil circulation path 40 is not only heated by the heating part 44, but is also increased in temperature by the internal combustion engine 100 warming up. As a result, the temperature of the oil in the high temperature side oil circulation path 40 rises faster than the temperature of the oil in the low temperature side oil circulation path 30, but is correlated to a certain extent with the temperature of the oil in the low temperature side oil circulation path 30. For this reason, the ECU 90 may use the oil transport mechanism 70 to transport oil from the low temperature side oil circulation path 30 to the high temperature side oil circulation path 40 until the temperature detected by the high temperature side oil temperature sensor 91 detecting the temperature of the oil in the high temperature side oil circulation path 40 reaches the fourth temperature if the environmental temperature detected by the environmental temperature sensor 92 is equal to or less than the second temperature when the internal combustion engine 100 is started up. The fourth temperature is predetermined, for example, is set to the temperature of the oil in the high temperature side oil circulation path 40 detected after the internal combustion engine 100 warms up. In this case, the low temperature side oil temperature sensor 93 may be omitted from the oil circulation system 1.

<Transport Processing>

Figure 14:
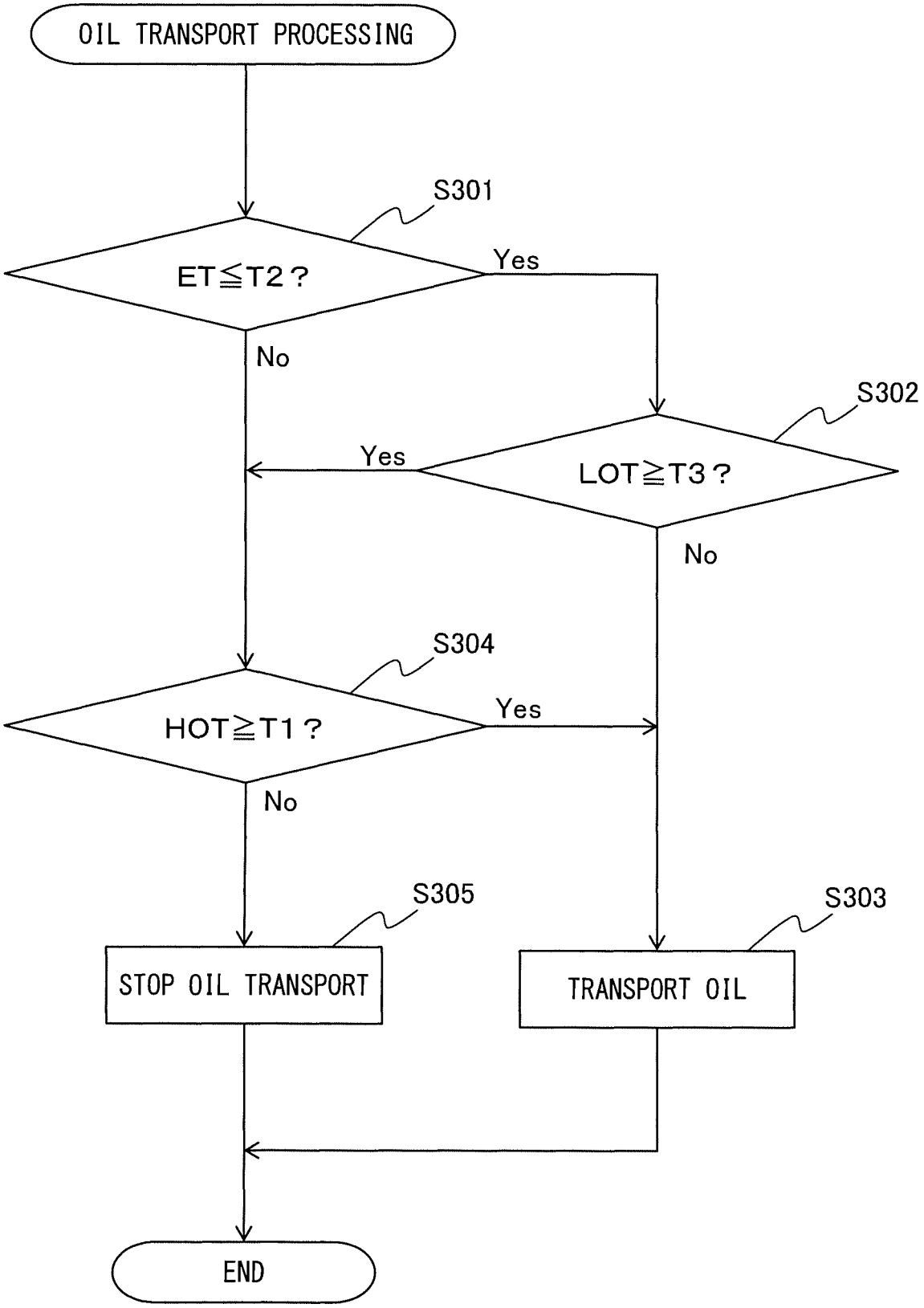
FIG. 14 is a flow chart showing a control routine of oil transport processing in the third embodiment of the present invention.

Below, referring to FIG. 14, the control for transporting oil from the low temperature side oil circulation path 30 to the high temperature side oil circulation path 40 in the third embodiment will be explained. FIG. 14 is a flow chart showing a control routine of oil transport processing in the third embodiment of the present invention. The present control routine is executed repeatedly by the ECU 90 at predetermined intervals after the internal combustion engine 100 is started up.

First, at step S301, it is judged whether the environmental temperature ET is equal to or less than a predetermined second temperature T2 when the internal combustion engine 100 is started up. The environmental temperature ET is detected by the environmental temperature sensor 92. If it is judged that the environmental temperature ET is equal to or less than the second temperature T2, the present control routine proceeds to step S302.

At step S302, it is judged whether the temperature of the oil LOT in the low temperature side oil circulation path 30 is equal to or greater than a predetermined third temperature T3. The temperature of the oil LOT in the low temperature side oil circulation path 30 is detected by the low temperature side oil temperature sensor 93. If it is judged that the temperature of the oil LOT is less than the third temperature T3, the present control routine proceeds to step S303. At step S303, by the oil transport mechanism 70, oil is transported from the low temperature side oil circulation path 30 to the high temperature side oil circulation path 40. As a result, if the amount of the oil in the high temperature side oil pan 41 becomes equal to or greater than a predetermined amount, the oil in the high temperature side oil pan 41 moves to the low temperature side oil pan 31 and the oil in the low temperature side oil pan 31 rises in temperature. After step S303, the present control routine is ended.

On the other hand, if at step S301 it is judged that the environmental temperature ET is higher than the second temperature T2 or at step S302 it is judged that the temperature of the oil LOT is equal to or greater than the third temperature T3, the present control routine proceeds to step S304. Step S304, step S305, and step S303 are similar to step S101, step S102, and step S103 of FIG. 11, so explanations will be omitted.

Note that, the ECU 90 may use the oil transport mechanism 70 to transport oil from the high temperature side oil circulation path 40 to the low temperature side oil circulation path 30 if the environmental temperature detected by the environmental temperature sensor 92 is equal to or less than the second temperature when the internal combustion engine 100 is started up. For example, the ECU 90 uses the oil transport mechanism 70 to transport oil from the high temperature side oil circulation path 40 to the low temperature side oil circulation path 30 until the temperature detected by the low temperature side oil temperature sensor 93 reaches the third temperature if the environmental temperature detected by the environmental temperature sensor 92 is equal to or less than the second temperature when the internal combustion engine 100 is started up. In this case, at step S303, due to the oil transport mechanism 70, oil is transported from the high temperature side oil circulation path 40 to the low temperature side oil circulation path 30.

<Oil Ejection Processing>

Figure 15:
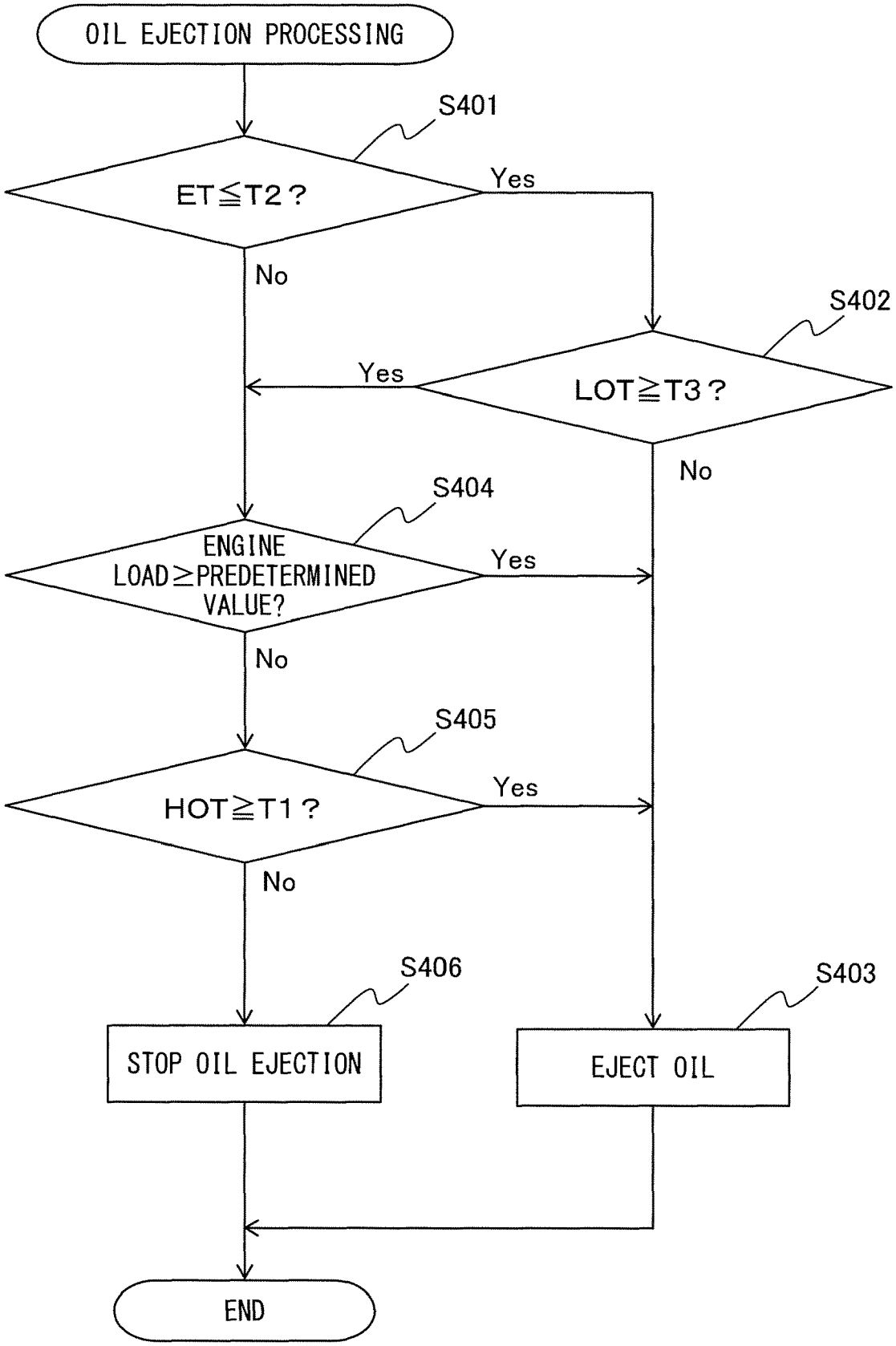
FIG. 15 is a flow chart showing a control routine of oil ejection processing in the third embodiment of the present invention.

Next, the control for ejecting oil from the oil jets 84 when like in the example of FIG. 9, oil jets 84 are used as the oil transport mechanism 70 in the third embodiment will be explained. FIG. 15 is a flow chart showing a control routine of oil ejection processing in the third embodiment of the present invention. The present control routine is executed repeatedly by the ECU 90 at predetermined time intervals after the internal combustion engine 100 is started up.

First, at step S401, it is judged whether the environmental temperature ET when the internal combustion engine 100 is started up is equal to or less than a predetermined second temperature T2. The environmental temperature ET is detected by the environmental temperature sensor 92. If it is judged that the environmental temperature ET is equal to or less than the second temperature T2, the present control routine proceeds to step S402.

At step S402, it is judged whether the temperature of the oil LOT in the low temperature side oil circulation path 30 is equal to or greater than a predetermined third temperature T3. The temperature of the oil LOT in the low temperature side oil circulation path 30 is detected by the low temperature side oil temperature sensor 93. If it is judged that the temperature of the oil LOT is less than the third temperature T3, the present control routine proceeds to step S403. At step S403, oil is ejected from the oil jets 84 and oil is transported from the low temperature side oil circulation path 30 to the high temperature side oil circulation path 40. As a result, if the amount of the oil in the high temperature side oil pan 41 becomes equal to or greater than a predetermined amount, the oil in the high temperature side oil pan 41 moves into the low temperature side oil pan 31 and the temperature of the oil in the low temperature side oil pan 31 rises. After step S403, the present control routine is ended.

On the other hand, if at step S401 it is judged that the environmental temperature ET is higher than the second temperature T2 or if at step S402 it is judged that the temperature of the oil LOT is equal to or greater than the temperature T3, the present control routine proceeds to step S404. Step S404, step S405, step S406, and step S403 are similar to step S201, step S203, step S204, and step S202 of FIG. 12, so explanations will be omitted.

Note that, at step S302 of FIG. 14 and step S402 of FIG. 15, it may be judged whether a predetermined time has elapsed from startup of the internal combustion engine 100. Further, at step S302 of FIG. 14 and step S402 of FIG. 15, it may be judged whether the temperature of the oil HOT in the high temperature side oil circulation path 40 is equal to or greater than a predetermined fourth temperature T4. The temperature of the oil HOT in the high temperature side oil circulation path 40 is detected by the high temperature side oil temperature sensor 91. Note that, the fourth temperature T4 is a temperature lower than the first temperature T1. Further, step S304 of FIG. 14 and step S405 of FIG. 15 may be omitted and oil may be transported at predetermined intervals after the internal combustion engine 100 warms up.

Above, preferred embodiments according to the present invention were explained, but the present invention is not limited to these embodiments. Various modifications and changes may be made within the language of the claims.

REFERENCE SIGNS LIST

1, 1', 1". oil circulation system
30. low temperature side oil circulation path
31. low temperature side oil pan
33. low temperature side parts supplied with oil
40. high temperature side oil circulation path
41. high temperature side oil pan
43. high temperature side parts supplied with oil
44. heating part
70. oil transport mechanism
90. electronic control unit (ECU)
100. internal combustion engine

The invention claimed is:

1. An oil circulation system of an internal combustion engine comprising:

a high temperature side oil circulation path provided with a high temperature side oil pan storing oil, a high temperature side part supplied with oil to which oil in the high temperature side oil pan is supplied, and a heating part heating oil supplied to the high temperature side part supplied with oil, and circulating oil among the high temperature side oil pan, the high temperature side part supplied with oil and the heating part;

a low temperature side oil circulation path provided with a low temperature side oil pan storing oil and a low temperature side part supplied with oil to which oil in the low temperature side oil pan is supplied, and circulating oil between the low temperature side oil pan and the low temperature side part supplied with oil;

an oil transport mechanism transporting oil between the low temperature side oil circulation path and the high temperature side oil circulation path;

a control device configured to control transport of oil by the oil transport mechanism while the internal combustion engine is operating, and a high temperature side oil temperature sensor detecting a temperature of the oil in the high temperature side oil circulation path, wherein the control device is configured to transport oil from the low temperature side oil circulation path to the high temperature side oil circulation path by the oil transport mechanism when the temperature of the oil detected by the high temperature side oil temperature sensor is equal to or greater than a predetermined first temperature; and the high temperature side oil circulation path is configured so that oil circulates through the high temperature side oil pan, the heating part, and the high temperature side part supplied with oil in that order, and the high temperature side oil temperature sensor is provided between the heating part and the high temperature side part supplied with oil.

2. The oil circulation system of an internal combustion engine according to claim 1, further comprising an environmental temperature sensor detecting an environmental temperature, wherein the high temperature side oil pan and the low temperature side oil pan are configured so that oil in the high temperature side oil pan moves into the low temperature side oil pan when the oil in the high temperature side oil pan becomes equal to or greater than a predetermined amount while the internal combustion engine is operating, and the control device is configured to transport oil from the low temperature side oil circulation path to the high temperature side oil circulation path by the oil transport mechanism if the environmental temperature detected by the environmental temperature sensor is equal to or less than a predetermined second temperature when the internal combustion engine is started up.

3. The oil circulation system of an internal combustion engine according to claim 2, further comprising a low temperature side oil temperature sensor detecting a temperature of the oil in the low temperature side oil circulation path, wherein the control device is configured to transport oil from the low temperature side oil circulation path to the high temperature side oil circulation path by the oil transport mechanism until the temperature detected by the low temperature side oil temperature sensor reaches a predetermined third temperature if the environmental temperature detected by the environmental temperature sensor is equal to or less than the second temperature when the internal combustion engine is started up.

4. The oil circulation system of an internal combustion engine according to claim 1, wherein the oil transport mechanism comprises an oil jet ejecting oil toward an inside of a piston provided in the internal combustion engine and, the oil jet is provided at the low temperature side oil circulation path, and the high temperature side oil pan is configured to recover oil ejected by the oil jet.

* * * * *